US009951618B2

(12) United States Patent
Moreno

(10) Patent No.: US 9,951,618 B2
(45) Date of Patent: Apr. 24, 2018

(54) REMOVABLE BARRIER FOR PROTECTING TUNNELS AND OTHER STRUCTURES FROM FLOODING AND OTHER HAZARDS

(71) Applicant: Jorge O. Moreno, Lindenhurst, NY (US)

(72) Inventor: Jorge O. Moreno, Lindenhurst, NY (US)

( * ) Notice: Subject to any disclaimer, the term of this patent is extended or adjusted under 35 U.S.C. 154(b) by 222 days.

(21) Appl. No.: 14/445,971

(22) Filed: Jul. 29, 2014

(65) Prior Publication Data

US 2015/0034254 A1 Feb. 5, 2015

Related U.S. Application Data

(60) Provisional application No. 61/860,005, filed on Jul. 30, 2013.

(51) Int. Cl.
*A47G 5/00* (2006.01)
*E21D 9/14* (2006.01)
*E21F 17/107* (2006.01)

(52) U.S. Cl.
CPC ..... *E21D 9/14* (2013.01); *E21F 17/107* (2013.01)

(58) Field of Classification Search
CPC ..... E21F 17/107; E21F 17/103; E21F 1/14; E21F 1/10; E21F 1/145; E21D 9/14; E21D 9/06; E21D 9/0607; E21D 11/38; E21D 11/383; E02B 3/16
USPC ..... 405/115, 147; 160/351, 368.1; 454/168–172
See application file for complete search history.

(56) References Cited

U.S. PATENT DOCUMENTS 3,972,272 A * 8/1976 Bagby ..... E21F 17/103 29/432
4,009,649 A * 3/1977 Thimons ..... E21F 17/103 277/917
4,023,372 A * 5/1977 Presler ..... E21F 17/107 405/132

(Continued)

OTHER PUBLICATIONS

Mike M. Ahlers, "Huge plugs could have spared subways from flooding, devleopers say," CNN U.S., Nov. 1, 2012; http://www.CNN.com.

(Continued)

*Primary Examiner* — Katherine W Mitchell
*Assistant Examiner* — Jeremy C Ramsey
(74) *Attorney, Agent, or Firm* — Betsy Kingsbury Dowd; BKDowd Law, P.C.

(57) ABSTRACT

A system for preventing fluid from entering a walled structure includes a support structure configured for fixing to at least one surface of the walled structure; and a barrier apparatus attachable and anchorable to the support structure, the barrier apparatus including a fluid retention member configured for intercepting a fluid entering the walled structure, and a collar for holding the fluid retention member against an interior surface of the walled structure, proximate the opening. As fluid enters the barrier apparatus, the pressure increases against the interior surface of the fluid retention member, pressing it against the walled structure. The collar in combination with the fluid retention member to which it is attached acts like a gasket to tighten a seal between the barrier apparatus and the walled structure.

16 Claims, 26 Drawing Sheets

(56) References Cited

U.S. PATENT DOCUMENTS

| | | | | |
|---|---|---|---|---|
| 4,040,210 | A * | 8/1977 | Land | E06B 7/28 160/90 |
| 5,683,294 | A * | 11/1997 | Maines | E21F 1/14 299/12 |
| 7,281,879 | B2 | 10/2007 | Cho et al. | |
| 8,082,970 | B2 * | 12/2011 | Gower | E06B 9/02 160/120 |
| 8,292,559 | B1 * | 10/2012 | Foggy | B60P 7/0876 410/96 |
| 8,365,804 | B1 * | 2/2013 | Genovese | E06B 3/80 160/351 |
| 2007/0218825 | A1 * | 9/2007 | Howery | E21F 1/14 454/170 |
| 2009/0197518 | A1 * | 8/2009 | Reuther | A62B 31/00 454/170 |
| 2011/0135395 | A1 * | 6/2011 | Lundman | E21F 17/107 405/147 |

OTHER PUBLICATIONS

Mark Fischetti , "Storm of the Century," Scientific American (Jun. 2013) : pp. 59-67. Print.

* cited by examiner

REMOVABLE BARRIER FOR PROTECTING TUNNELS AND OTHER STRUCTURES FROM FLOODING AND OTHER HAZARDS

CROSS-REFERENCE TO RELATED APPLICATIONS

This application claims the benefit of and priority to U.S. Provisional Application Ser. No. 61/860,005 entitled "REMOVABLE BARRIER FOR PROTECTING TUNNELS AND OTHER STRUCTURES FROM FLOODING AND OTHER HAZARDS," filed Jul. 30, 2013, the entirety of which is hereby incorporated herein by reference thereto.

FIELD OF DISCLOSURE

The present disclosure relates to removable barriers for protecting tunnels and other structures from gas and water flow, in particular, from flooding or toxic gas.

BACKGROUND

The effects of flooding on properties and human life has been a long standing and continuing problem, particularly in heavily populated metropolitan areas. To lessen the cost and time of recovery, recent efforts have been directed to developing barriers that can be used at the entranceway of tunnels and/or subways. It has been recognized that such barriers would also be useful in thwarting a terrorist gas attacks in such areas.

For example, as publicized in a Nov. 1, 2012 report by CNN U.S., the U.S. government is in the process of developing a huge inflatable plug which inflates like a balloon to fit the contours of a tunnel and which reportedly can reduce leakage to an amount controllable by a pump. The project has been named the "Resilient Tunnel Project." The plug, which must be individually sized to fit a particular tunnel of particular dimension, consists of three layers, including an outer layer of thick webbing made of a liquid-crystal polymer fiber. A "typical" tunnel plug can be inflated in about three minutes and once inflated, is pressurized with either air or water. The cost of one plug is reportedly about $400,000.

While an improvement over past attempts to protect tunnels and subways from floods or threats of gas attacks, the tunnel plug is costly.

There is still a need for a versatile, portable and removable barrier for the prevention of flooding and gas attacks for tunnels, subways, and other covered structures that is also cost efficient and easily adaptable to different structures of various sizes.

SUMMARY

Features of the disclosure will become apparent from the following detailed description considered in conjunction with the accompanying drawings. It is to be understood, however, that the drawings are designed as an illustration only and not as a definition of the limits of this disclosure.

The present disclosure is directed to a versatile, portable and removable barrier system for protection from flooding and/or gas attacks of structures such as tunnels, subways, pipes, other conduits and so on, that is also cost efficient and easily adaptable to different structures of various sizes. The portable and removable barrier can prevent, or at least significantly minimize, the entrance of fluids (liquid and/or gas) into the opening of the tunnel or other walled structure. In addition, the barrier advantageously has a short set-up time, and also a short removal time, allowing for normal use of the tunnels and subways once the need for the barrier system has passed.

In one aspect, the present disclosure is directed to a system for preventing fluid from entering a walled structure, the system including: a support structure, the support structure configured for fixing to at least one surface of a walled structure; and a barrier apparatus attachable and anchorable to the support structure, the barrier apparatus including a fluid retention member with an opening configured for intercepting a fluid entering the walled structure, and a collar positioned around an interior surface of the fluid retention member and proximate the opening, the collar configured to hold the fluid retention member against an interior surface of the walled structure upon installation.

In another aspect, at least a portion of the fluid retention member extends beyond the collar and into the walled structure during operation.

In a further aspect, increasing pressure from the fluid intercepted by the fluid retention member presses the collar and the fluid retention member against the interior surface of the walled structure, thereby tightening a seal between the barrier apparatus and the walled structure.

In yet a further aspect, the collar includes a pneumatic collar, wherein the pneumatic collar is inflatable for installation and operation and collapsible for storage.

The system can further include an inflating device configured for inflating the pneumatic collar.

In still a further aspect, the system includes a pressure gauge configured for monitoring a pressure of the pneumatic collar during operation.

In yet another aspect, the system includes a control device, the control device activating the inflating device to further inflate the pneumatic collar in response to the pressure gauge monitoring a predetermined pressure drop in the pressure of the pneumatic collar during operation.

In another aspect, the barrier apparatus further includes a netting structure, the netting structure encompassing the fluid retention member and configured for attaching and anchoring to the support structure.

The netting structure, in some aspects, includes loops for attaching and anchoring the netting structure and the fluid retention member to the support structure.

The fluid retention member and the netting structure can be separately attachable to the support structure.

In some aspects, the fluid retention member includes a continuous pliable membrane.

In some aspects, the collar includes an inflatable pneumatic collar. In additional aspects, the pneumatic collar is integral with the continuous pliable membrane.

In yet additional aspects, the support structure includes a plurality of anchoring devices permanently attached to and spaced around a front entrance surface of the walled structure, the plurality of anchoring devices configured for attaching the loops of the netting structure and the fluid retention member thereto, the barrier apparatus being removably attachable to the plurality of anchoring devices.

In some aspects of the system formed in accordance with the present disclosure, the support structure includes a plurality of wall-supported beams positioned between opposing surfaces of the walled structure, and pressure-generating footings configured for installing and anchoring the wall-supported beams to the walled structure, each of the wall-supported beams including a connecting element proximate each of its ends, the barrier apparatus being removably attachable and anchorable to the support structure via the connecting elements.

In additional aspects, the plurality of wall-supported beams are vertically positioned, each including a pressure-generating ninety-degree wall-supported footing at an upper end configured for removably attaching to a front surface of the walled structure, each of the wall-supported beams further configured for detaching the upper end from the walled structure and reclining the wall-supported beams to a horizontal position when not in use.

In certain aspects, the walled structure is one of a tunnel and subway.

The present disclosure is also related to a removable barrier apparatus for preventing fluid from entering a walled structure, the barrier apparatus configured for operably attaching and anchoring to the walled structure. The barrier apparatus includes a fluid retention member with an opening configured for intercepting a fluid entering the walled structure; and a collar positioned around an interior surface of the fluid retention member and proximate the opening, the collar configured to hold the fluid retention member against an interior surface of the walled structure upon installation, wherein increasing pressure from the fluid intercepted by the fluid retention member presses the collar and the fluid retention member against the interior surface of the walled structure, thereby tightening a seal between the barrier apparatus and the walled structure.

In one aspect of the barrier apparatus, the collar includes a pneumatic collar, wherein the pneumatic collar is inflatable for installation and operation and collapsible for storage.

In another aspect, the barrier apparatus further includes an inflating device configured for inflating the pneumatic collar, a pressure gauge configured for monitoring a pressure of the pneumatic collar during operation, and a control device, the control device activating the inflating device to further inflate the pneumatic collar in response to the pressure gauge monitoring a predetermined pressure drop in the pressure of the pneumatic collar during operation.

In yet another aspect, the barrier apparatus includes a netting structure, the netting structure encompassing the fluid retention member and configured for removably attaching and anchoring to the walled structure.

In various aspects, the support structure, can be a wall-supported structure or an anchored structure, for anchoring the barrier apparatus to the structure of the tunnel, and a fluid retention device attached thereto. The support structure of the barrier apparatus preferably uses the interior walls of the walled structure, e.g., tunnel and, optionally, the front surface of the tunnel surrounding the entrance, or other walled structure to brace itself thereto.

In some aspects, the fluid retention device includes a continuous pliable membrane and an annular pneumatic collar surrounding and integral with the continuous pliable membrane.

In some aspects, the barrier apparatus also preferably includes a netting structure encompassing the fluid retention device for supporting and anchoring the membrane to the support structure. The netting structure can further include attaching loops for attaching and anchoring the netting structure to the support structure.

In operation, for example, in one embodiment, as fluid enters and fills the walled structure, the fluid presses the walls of the continuous pliable membrane outward, until it takes the shape of the interior of the tunnel or other walled structure. The supporting netting structure (which includes netting or mesh) surrounds the continuous pliable membrane and is connected via the attaching loops to the support structure, which in turn is anchored to the tunnel or other walled structure. The pneumatic collar is positioned around the opening of the continuous pliable membrane and is inflated to also substantially take the shape of the opening of the tunnel. As the fluid enters and increases the outward pressure on the continuous pliable membrane behind the collar, the collar and the continuous pliable membrane are pressed against the walls of the tunnel, and act like a gasket to fill any gaps and tighten a seal between the barrier apparatus and the walled structure. In addition, as the continuous barrier membrane behind the pneumatic collar fills up with liquid, together with the anchoring of the netting structure, the filled continuous membrane helps to prevent any slippage of the pneumatic collar from its position near the opening of the tunnel or walled structure. As fluids enter the pliable membrane, the air pressure in the pneumatic collar can be maintained or increased. The increased force of entering flood waters, for example, on the pliable membrane will force the pliable membrane to expand against the pneumatic collar and against the walls of the tunnel behind the collar until the fluid retention device creates a self-activating seal against the walls of the tunnel. The more the pressure increases on the internal surfaces of the pliable membrane from the impinging flood waters, the tighter both the pneumatic collar and the pliable membrane are pressed against the walls of the tunnel.

In some aspects, an inflation device remains attached to the pneumatic collar after inflation and during operation. In one aspect, a pressure gauge is further provided to monitor the pressure of the pneumatic collar. In additional aspects, the apparatus includes a feedback circuit to monitor the pressure in the pneumatic collar and to inflate the pneumatic collar using the inflation device in response to a measured drop in the pressure in order to maintain constant pressure in the pneumatic collar.

In one aspect, the fluid retention device is attached to the netting. In other aspects, the fluid retention device can be detached from the netting.

In one aspect, the support structure includes a wall-supported beam structure that is, at least in part, removable along with the barrier apparatus. In various additional aspects, the wall-supported beam structure can be staggered across a width and/or height of the walled structure to increase load capacity. In still other aspects, the wall-supported beam structure can include footings which anchor a load bearing structure.

In another aspect, the support structure includes an anchored unit, which includes a plurality of anchoring devices for attaching to the tunnel or other structure, preferably on a front surface surrounding an opening to the tunnel or other structure. The support structure, for example, the wall supported beam structure or anchored unit, in some aspects, includes attachment structures for quickly attaching the attaching loops of the netting structure thereto.

In other aspects, the support structures, including anchoring and attachment structures for attaching to the loops of the netting structure are formed of materials that are non-corrosive, long lasting and easy to assemble for quick implementation.

In addition to the above aspects of the present disclosure, additional aspects, objects, features and advantages will be apparent from the embodiments presented in the following description and in connection with the accompanying drawings.

BRIEF DESCRIPTION OF THE DRAWINGS

The drawings constitute a part of this disclosure and include examples, which may be implemented in various forms. It is to be understood that in some instances, various aspects of the disclosure may be shown exaggerated or enlarged to facilitate understanding. The teaching of the disclosure can be readily understood by considering the following detailed description in conjunction with the accompanying drawings.

DETAILED DESCRIPTION

The following sections describe particular embodiments. It should be apparent to those skilled in the art that the described embodiments provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present method and system as defined herein and equivalents thereto.

Throughout the description, where items are described as having, including, or comprising one or more specific components, or where methods are described as having, including, or comprising one or more specific steps, it is contemplated that, additionally, there are items of the present disclosure that consist essentially of, or consist of, the one or more recited components, and that there are methods according to the present disclosure that consist essentially of, or consist of, the one or more recited processing steps.

It should be appreciated that the particular embodiments described herein are illustrative of the disclosure and its best mode, if known, and are not intended to otherwise limit the scope of the present disclosure in any way. For the sake of brevity, conventional hardware and components and so on used in the embodiments of the disclosure may not be described in detail herein.

The present disclosure is directed to removable barriers and systems for protecting any walled structure, such as tunnels, subways, pipes and other conduits and walled structures, from gas and/or water flow, in particular, from toxic gas or flooding.

While the present disclosure describes various features of the present system and devices in particular reference to preventing a tunnel from being flooded by a storm surge or flood waters, for example, it should be understood that the scope of the present disclosure is not limited thereto, and can include preventing or minimizing any unwanted fluid, whether naturally occurring or resulting from an attack, from entering any walled structure that is exposed to the elements and that has an entrance through which such unwanted fluids could enter.

Embodiments of the removable barrier apparatus formed in accordance with the present disclosure can provide a high pressure pneumatic fluid retention system that is versatile and adaptable to different applications and different structures.

Figure 1:
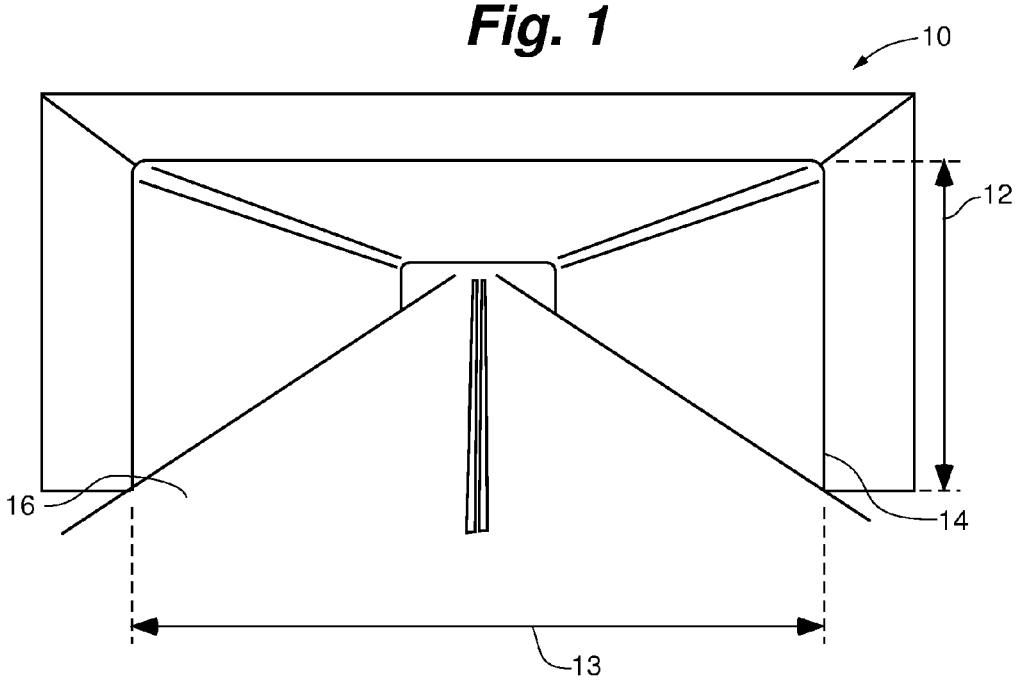
FIG. 1 is a pictorial representation of a front perspective view of an opening of a tunnel for attaching a removable barrier apparatus formed in accordance with the present disclosure.

Referring to FIG. 1, in particular embodiments described herein, the present disclosure is directed to a system and removable barrier apparatus for preventing fluid, such as water, from entering a tunnel 10. While the tunnel described in the figures is assumed to be about 14 feet in height 12 and about 20 feet in width 13, the system and barrier apparatus formed in accordance with the present disclosure can be adapted to accommodate any size and shape of any appropriate walled structure.

Figure 2:
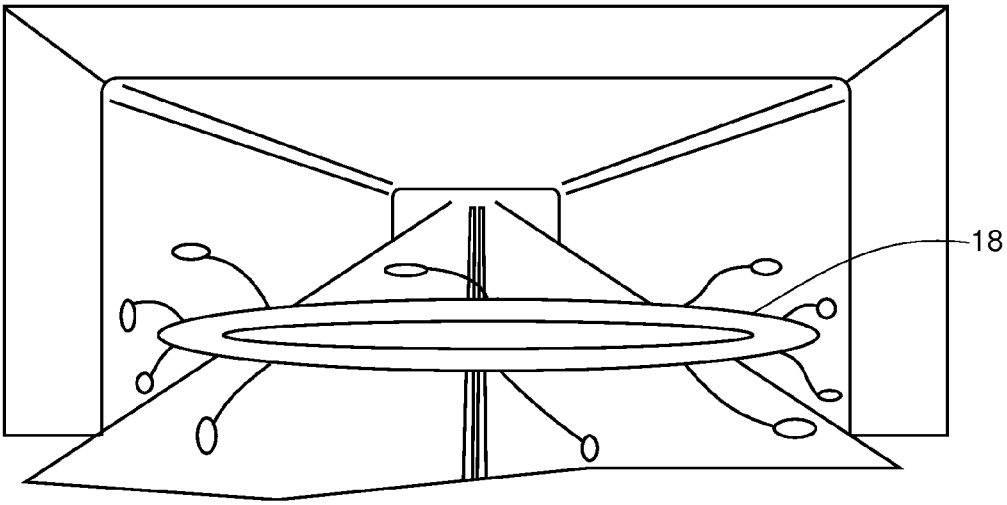
FIG. 2 is a front perspective view of the tunnel entrance of FIG. 1 with an embodiment of a removable barrier apparatus of the present disclosure placed on a ground surface at the tunnel entrance prior to installation.

The tunnel shown in FIG. 1 is an example of a walled structure that is covered. The tunnel 10 has side walls 14 and, taken together with road surface 16, is of a rectangular or partially arched shape. Referring also to FIG. 2, an embodiment of a removable barrier apparatus 18 formed in accordance with the present disclosure is shown laid out on a roadway of the tunnel 10 before it is attached to the tunnel 10, which has a vertical opening that is substantially rectangular in cross-section. In other embodiments, such as in the case of a subway, for example, the removable barrier apparatus can also be aligned to a horizontal opening.

In still other embodiments, the removable barrier apparatus is configured for covering a tubular walled structure, such as a pipe, which has a circular cross-section. In yet additional embodiments, the removable barrier apparatus can be affixed at any angle to accommodate the orientation of the opening of the walled structure.

Figure 3:
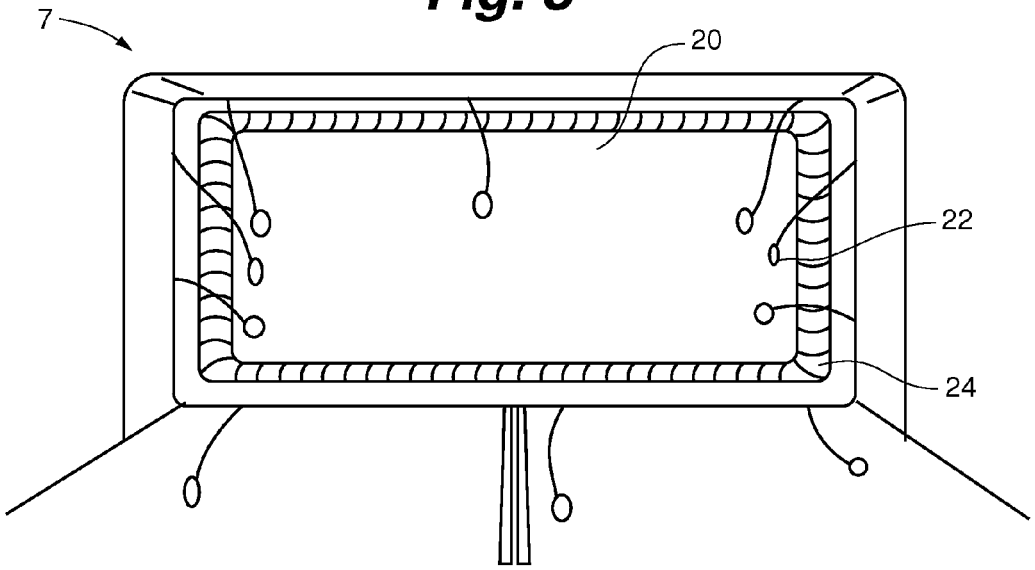
FIG. 3 is a pictorial representation of a front view of the removable barrier apparatus of FIG. 2, inflated for installation, shown positioned at the tunnel entrance.

FIG. 3 shows an embodiment of the removable barrier apparatus 18 positioned in an opening of the tunnel 10 before the apparatus 18 is secured to the tunnel 10 for operation. The removable barrier apparatus 18 preferably includes a netting structure 9 (see also FIG. 22A) and a fluid retention device 7. In certain embodiments, the fluid retention device 7 further includes a fluid retention member 20 and an inflatable pneumatic collar 24 or annular ring positioned at the opening of the member 20.

In particular embodiments, the fluid retention member 20 is a continuous pliable membrane. The inflatable pneumatic collar forms an annular ring that surrounds the member 20 and can be positioned at the entrance opening of the member 20, or behind the entrance opening of the member 20. As shown in FIGS. 3 and 22A-C, for example, a portion 42' of the fluid retention member 20 can extend forward of the pneumatic collar 24 for securing to the walled structure, as described further herein, and a portion of the fluid retention member 20 can also extend beyond the pneumatic collar 24 and further into the tunnel 10 (see FIG. 22A).

In some embodiments, the pneumatic collar 24 is integral with the continuous pliable membrane 20. Once inflated for operation and in position in the opening of the walled structure, at or proximate the entrance, the pliable membrane is preferably sandwiched between the interior walls of the tunnel 10 and the pneumatic collar.

Figure 12:
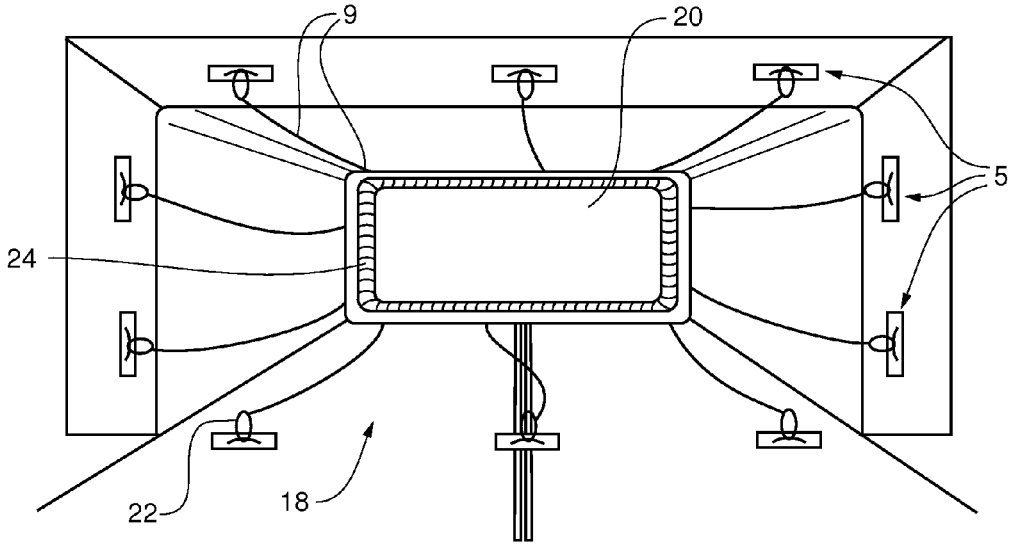
Figure 22A:
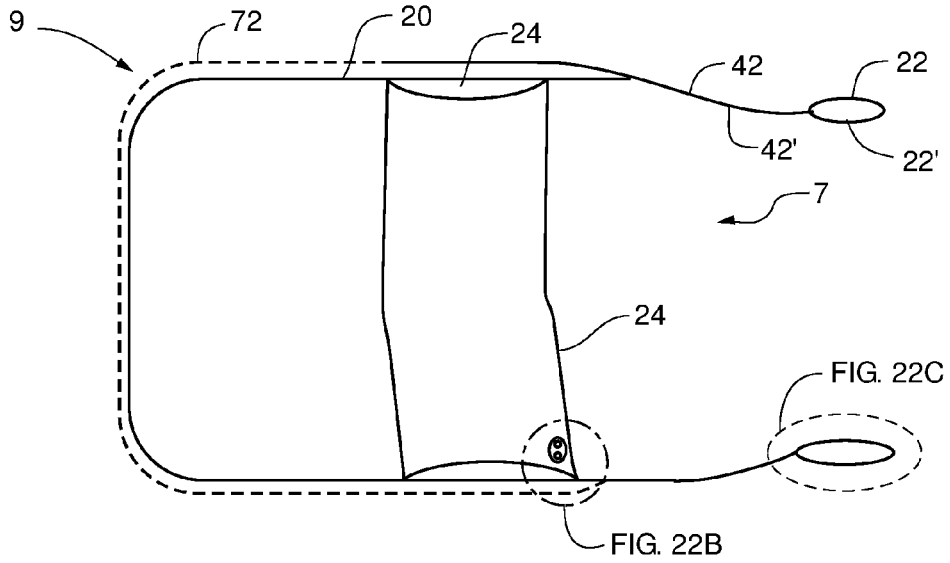
FIG. 22A is a pictorial representation of a side view of an embodiment of a removable barrier apparatus formed in accordance with the present disclosure.
Figure 22B:
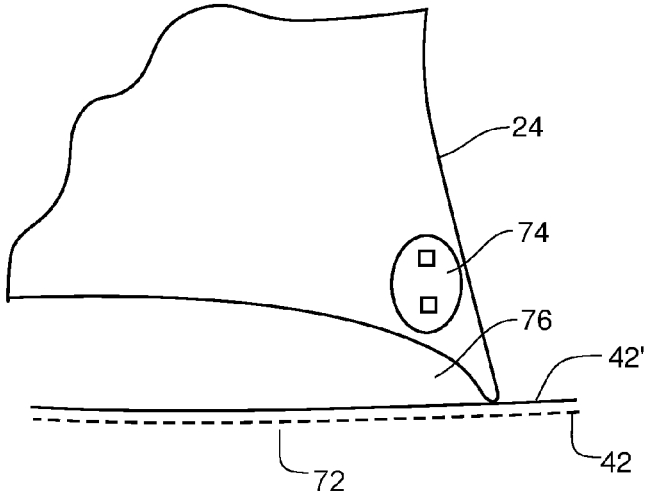
FIG. 22B is a pictorial representation of a magnified portion of the removable barrier apparatus of FIG. 22A.
Figure 23:
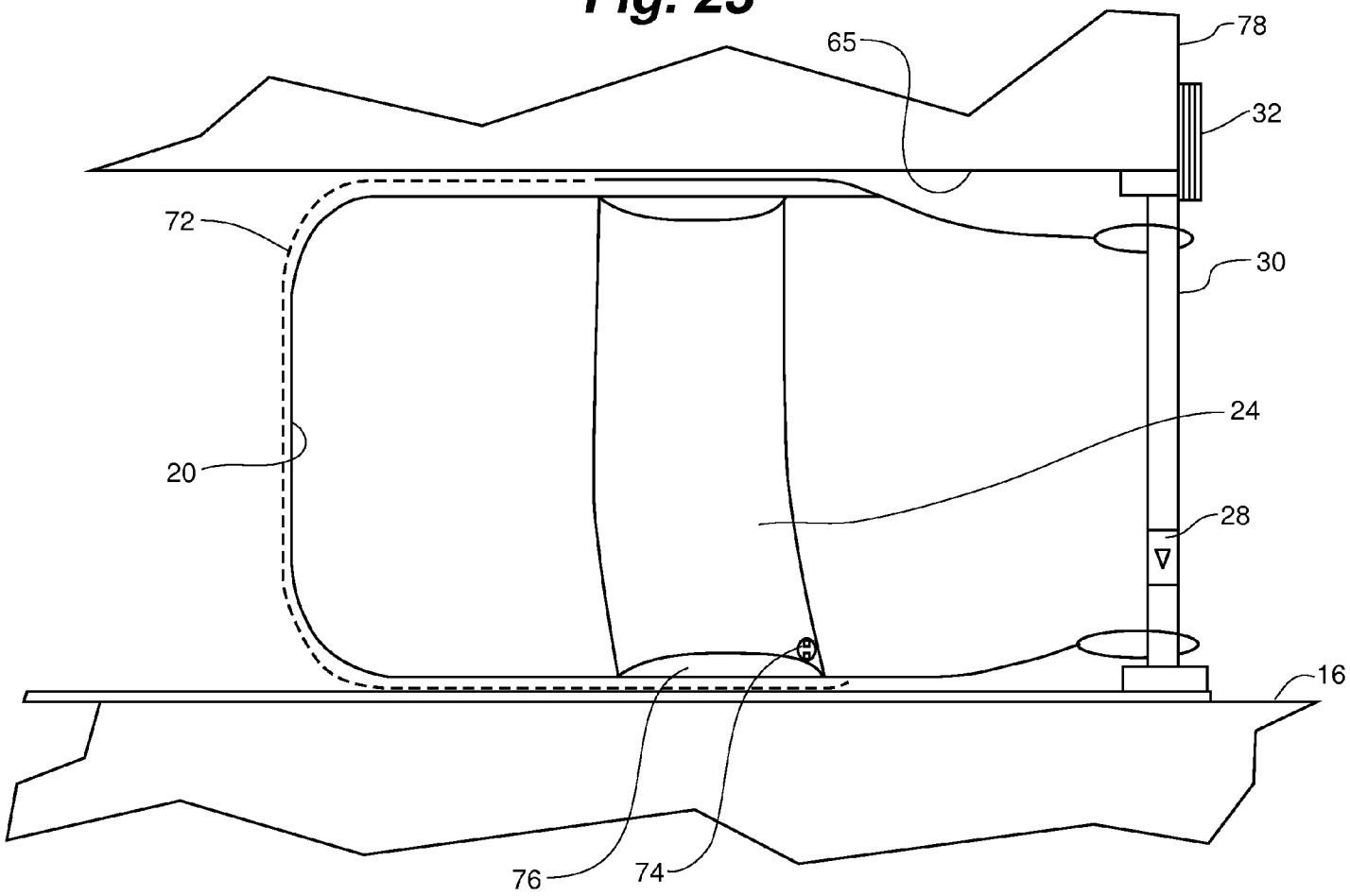
FIG. 23 is a pictorial representation of a side view of an embodiment of a system formed in accordance with the present disclosure installed in a tunnel, including the removable barrier apparatus of FIGS. 22A and 22B and an embodiment of a wall-supporting structure of the present disclosure.

As can be seen in FIGS. 22A, 22B, and 23, in some embodiments, the removable barrier apparatus 18 also includes a netting structure 9 that encompasses the fluid retention device 7 for supporting and anchoring the fluid retention member 20 to the walled structure. Referring also to FIG. 12, in some embodiments, the netting structure 9 includes attaching elements 22 in the form of loops, for example, for attaching and anchoring the netting structure 9 to an embodiment of a support structure formed in accordance with the present disclosure, such as support elements 5.

Embodiments of a system for preventing fluid from entering a walled structure can include any number of support structures to which the removable barrier apparatus will be attached during operation. In some embodiments, the support structure can be installed onto the walled structure concurrently with the removable barrier apparatus, so that the support structure is likewise removably attachable. In other embodiments, the support structures, or a portion thereof, are pre-installed, remaining permanently installed and/or integral to the walled structure. In these embodiments, the removable barrier apparatus can be quickly installed onto the permanent support structure just prior to its intended operation.

Referring to FIGS. 3, 6, 9, and 12, for example, in some embodiments, the removable barrier apparatus 18 includes attaching elements 22, which may be in the form of loops, for removably attaching and anchoring the apparatus 18 via an embodiment of a support structure formed in accordance with the present disclosure. The attaching elements 22 are operably attached to the netting structure 9 which encompasses the continuous pliable membrane 20, for example, via an attaching connector 42. The attaching connector 42 can be any suitable connecting device between the loop 22 and the netting structure 9, including a rope, a line, or a sling, for example, and may be integral with the mesh of the netting structure 9.

Figure 6:
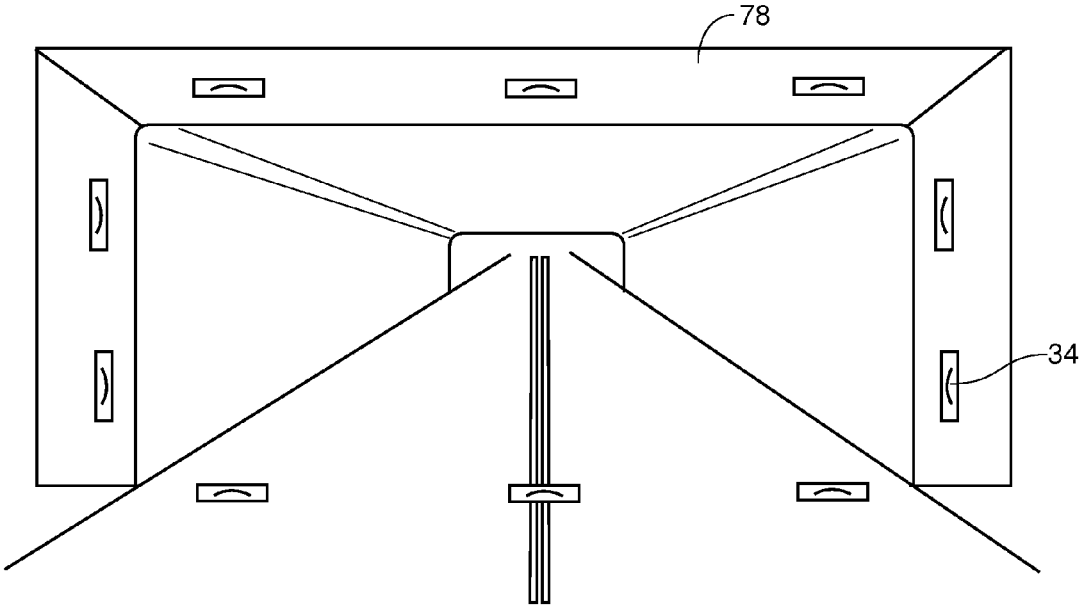
FIG. 6 is a pictorial front view representation of another embodiment of a support structure using an anchored structure for attaching various embodiments of a removable barrier apparatus formed in accordance with the present disclosure.
Figure 9:
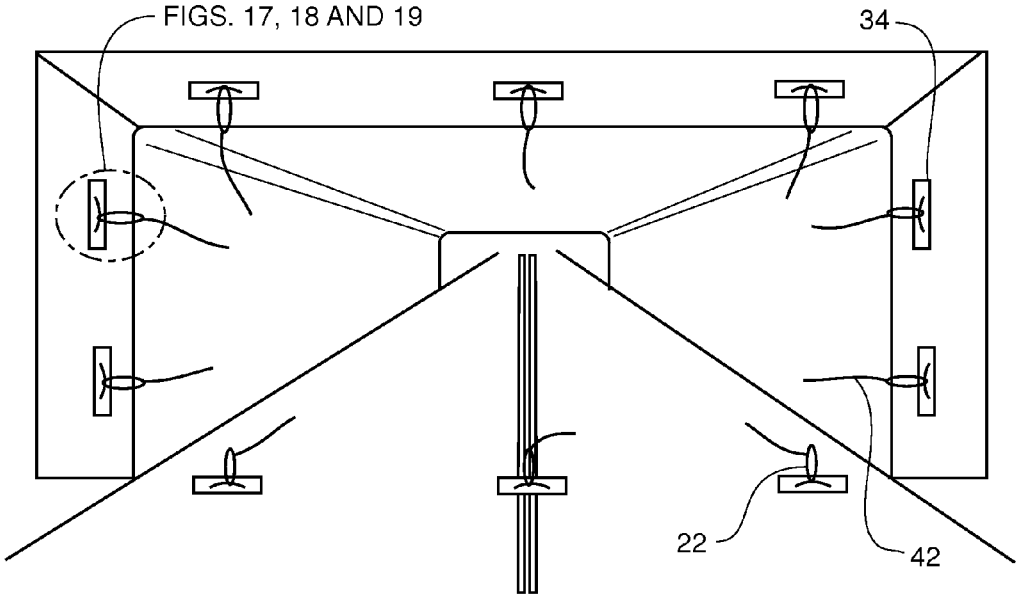

In the embodiments shown in FIGS. 6, 9, and 12, the support structure includes supporting elements 5 that are permanently embedded in the walled structure, for example, on a front face of the entrance wall 78 as well as on the road surface 16. The supporting elements 5 are preferably sufficiently positioned, in a sufficient amount, around the entrance of the tunnel 10 to allow the removable barrier apparatus 18 to intercept and prevent the movement of fluids through the walled structure and to remain properly anchored during operation.

Referring still to FIGS. 3, 6, 9, and 12, the supporting elements 5, in some embodiments, includes anchor points 34 attached directly to the front wall 78 of the tunnel, as well as to the floor of the tunnel or road surface 16. Preferably, these anchor points 34 are positioned in place, as shown in FIG. 6, well in advance of the complete installation of the removable barrier structure shown in FIG. 12, in other words, well in advance of an impending storm or terrorist attack. As shown in FIGS. 9 and 12, the attaching loops 22 can be attached directly onto anchoring units 34 forming the support structure as shown. Accordingly, this anchored version is advantageously quick to install, simple in construction, and also uses less materials than some other embodiments of the support structure described herein.

The removable barrier apparatus and support structure formed in accordance with the present disclosure provide an efficient system for resisting the entry of fluid into the walled structure. In operation, the continuous pliable membrane 20 behind the pneumatic collar 24 takes the shape of the opening of the tunnel or other walled structure, and the supporting netting structure 9 is connected via the attaching loops 22 to the supporting elements 5, which in turn is anchored to the tunnel or other walled structure. The pneumatic collar 24, which is positioned around an opening of the continuous pliable membrane 20, proximate an opening of the tunnel, is inflated in situ to press an outer portion of the membrane 20 and the netting 72 against the walls of the tunnel. The pneumatic collar 24 and pliable membrane 20 act like a gasket to fill any gaps between the walls of the tunnel and the outer surface of the pliable membrane 20. In particular, the increasing pressure of fluids filling the interior of the membrane 20 behind the collar act to seal and hold the barrier membrane 20 and collar 24 in position against the walls of the tunnel. As fluids enter the pliable membrane, the air pressure in the pneumatic collar is preferably maintained or increased in response thereto. The increased pressure of entering flood waters, for example, on the interior surface of the pliable membrane preferably force it to expand outward against the interior surface of the tunnel, and against the pneumatic collar 24, so that the fluid retention device 7 creates a self-activating seal against the walls of the tunnel. The more the pressure increases on the internal surfaces of the pliable membrane 20 from the impinging flood waters, the tighter both the pneumatic collar 24 and the pliable membrane 20 are sandwiched against the walls of the tunnel.

Embodiments of the fluid retention member and pneumatic collar can be formed of any material sufficiently pliable and impervious to the particular fluid it is intended to intercept. In some embodiments, the fluid retention member and the pneumatic collar are formed of the same material. In other embodiments, they are formed of different materials. In addition, the fluid retention member and/or pneumatic collar can also be coated with one or more layers of material(s) that further enhances the impermeability of the fluid retention member and/or pneumatic collar. Preferably, both the coating and base material maintain substantially impermeable when stretched during operation, for example, when subjected to flooding or storm surge conditions.

It should be noted that in operation, it is contemplated that the system of the present disclosure be implemented in both an entrance and exit opening of any such walled structure that would be subjected to storm conditions, for example, at both openings of a tunnel.

Embodiments of the system formed in accordance with the present disclosure can utilize any appropriate anchoring structures and systems known in the art to anchor the removable barrier apparatus during operation. For example, for the embodiments shown in FIGS. 3, 6, 9 and 12, any appropriate structure known in the art that is capable of holding the removable barrier structure in place during use can be used for anchoring units 34.

Figure 17:
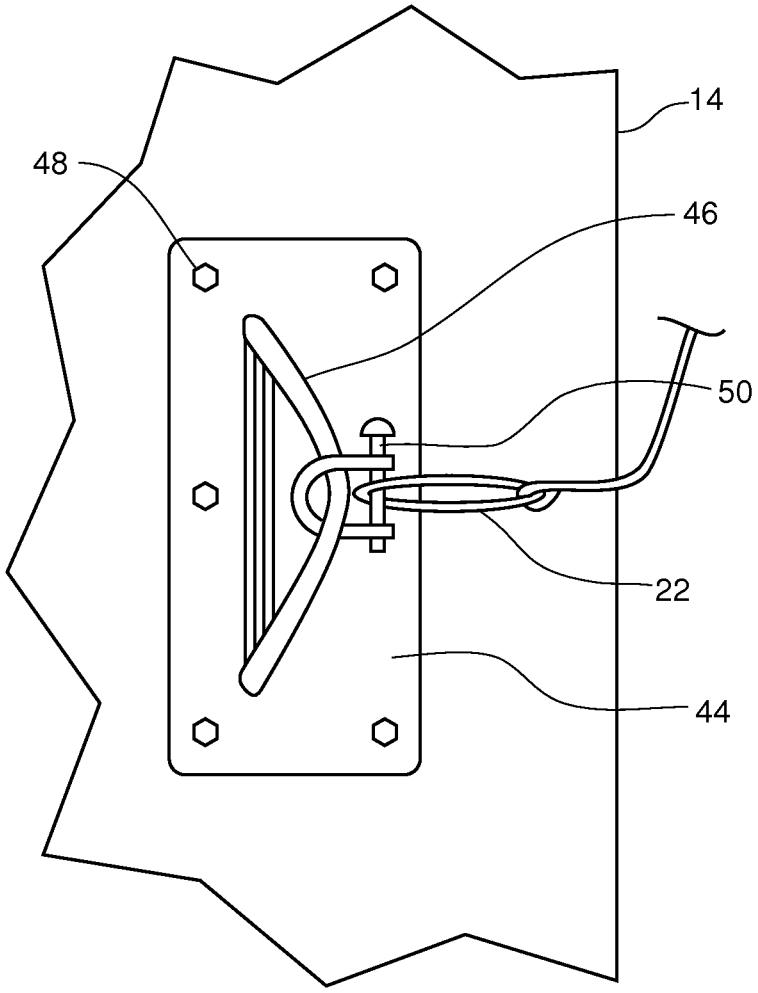
FIG. 17 is a magnified pictorial representation of one embodiment of the anchoring structures of FIG. 9 with attaching loops.
Figure 18:
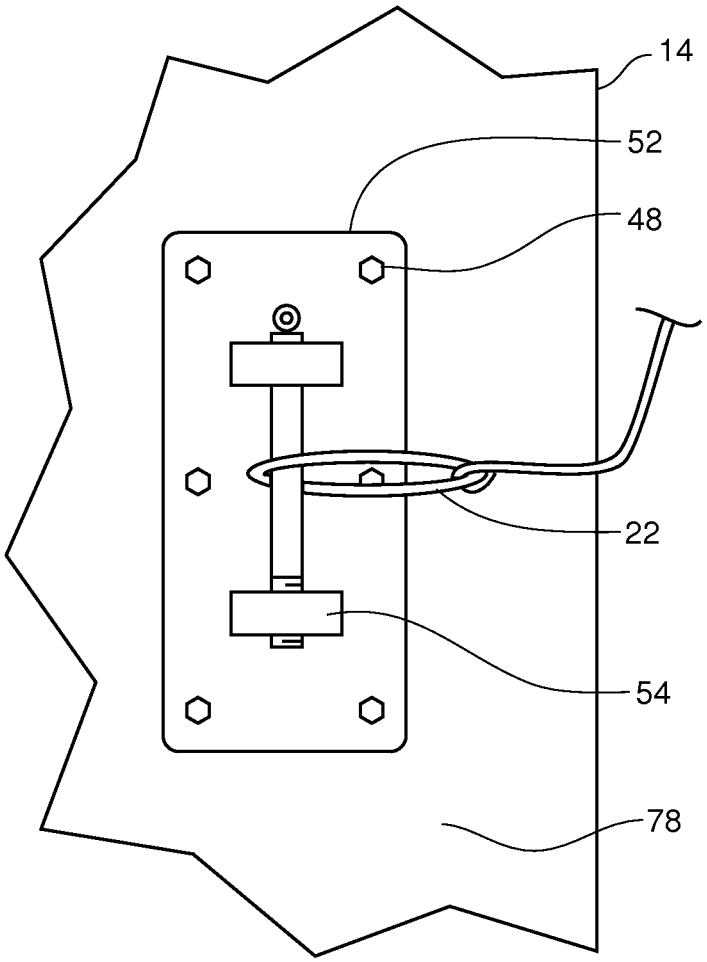
FIG. 18 is a magnified pictorial representation of another embodiment of the anchoring structures of FIG. 9 with attaching loops.
Figure 19:
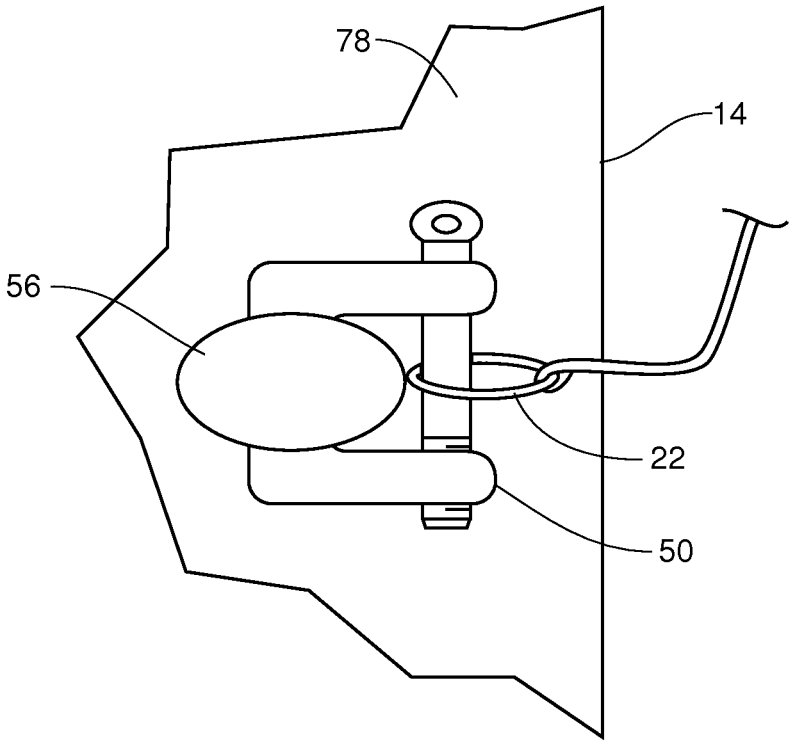
FIG. 19 is a magnified pictorial representation of yet another embodiment of the anchoring structures of FIG. 9 with attaching loops.

Various embodiments of anchoring units 34 are shown in FIGS. 17, 18 and 19. For example, in FIG. 17, a metal plate 44 is fixed with fasteners 48 to the front surface 78 surrounding the opening of the tunnel 10. A D-ring 46 is attached to the metal plate 44 and a shackle 50 is attached thereto, which can be opened for attaching the attaching loop 22 onto anchoring unit 34.

In FIG. 18, a metal plate 52 is fixed with fasteners 48 to the front surface 78 surrounding the opening of the tunnel. An incorporated closure 54 is attached thereto, which can be opened for attaching the attaching loop 22 onto anchoring unit 34.

In FIG. 19, an eye hook 56 is incorporated directly onto the front surface surrounding the opening of the tunnel, and a shackle 50 attached thereto. The shackle 50 can be opened for attaching the attaching loop 22 onto anchoring unit 34.

Figure 4:
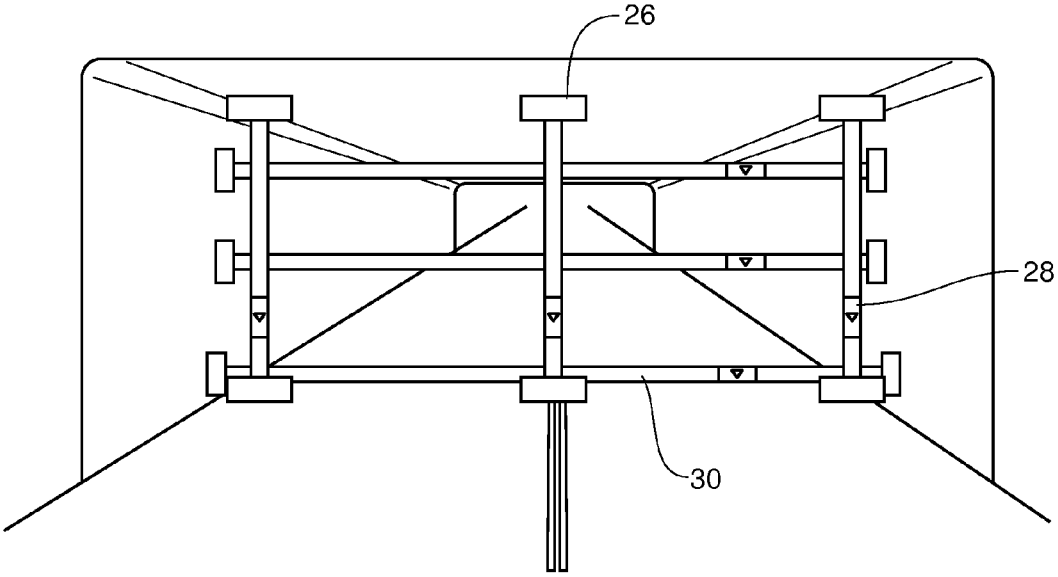
FIG. 4 is a pictorial front view representation of an embodiment of a support structure formed in accordance with the present disclosure, including a wall-supported beam structure, with pressure-generated flat wall support footing, for attaching various embodiments of the fluid retention device and netting structure to the tunnel of FIG. 1.
Figure 5:
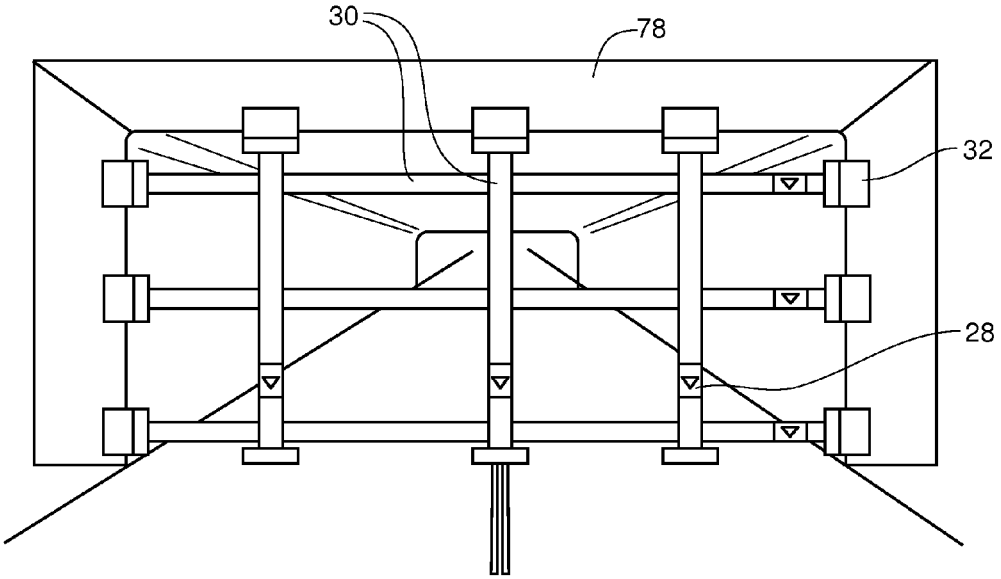
FIG. 5 is a pictorial front view representation of another embodiment of a support structure formed in accordance with the present disclosure, including another wall-supported beam structure with pressure-generated ninety-degree wall support footing, for attaching various embodiments of the fluid retention device and netting structure to the tunnel of FIG. 1.

Referring, for example, to FIGS. 4 and 5, other embodiments of the system formed in accordance with the present disclosure include a support structure that is, at least in part, removable for storage along with the removable barrier apparatus. For example, the support structure can include wall-supported beams, which are removable, and which can be made specifically for installment in a certain opening. In some embodiments, the wall-supported beams require no prior anchoring units to be constructed. However, as in most applications, it may be advisable prior to installation to prepare the opening of the tunnel or other structure it is designed to be installed onto, to remove, relocate, or reshape obstacles which would otherwise impede its function.

Referring to FIG. 4, in some embodiments, the support structure includes appropriately dimensioned wall-supported beams 30 with pressure-generating wall-supported footings 26 on each end for positioning and maintaining the beams 30 across a length and width of the tunnel. The beams are wall-supported and staggered inside the tunnel using the pressure-generating wall supports 26. Any pressure generating device 28 known in the art can be used to insure any of the types of wall-supported beams formed in accordance with the present disclosure remain in position once installed, including, but not limited to, mechanical, electro-mechanical or hydraulic screw-type pressure footings.

Referring to FIG. 5, in some embodiments, the wall-supported structure includes appropriately dimensioned wall-supported beams 30 with pressure-generating ninety-degree wall supported footings 32 on each end for positioning and maintaining the beams 30 across a length and width of the tunnel. The beams are staggered and use the front surface 78 of the tunnel walls for support, as shown more clearly in FIG. 16. Any pressure generating device 28 known in the art can be used to insure the beams 32 remain in position once installed.

In some embodiments, the support structure or system incorporates a combination of the wall supported and ninety-degree front-surface supported beams.

Figure 7:
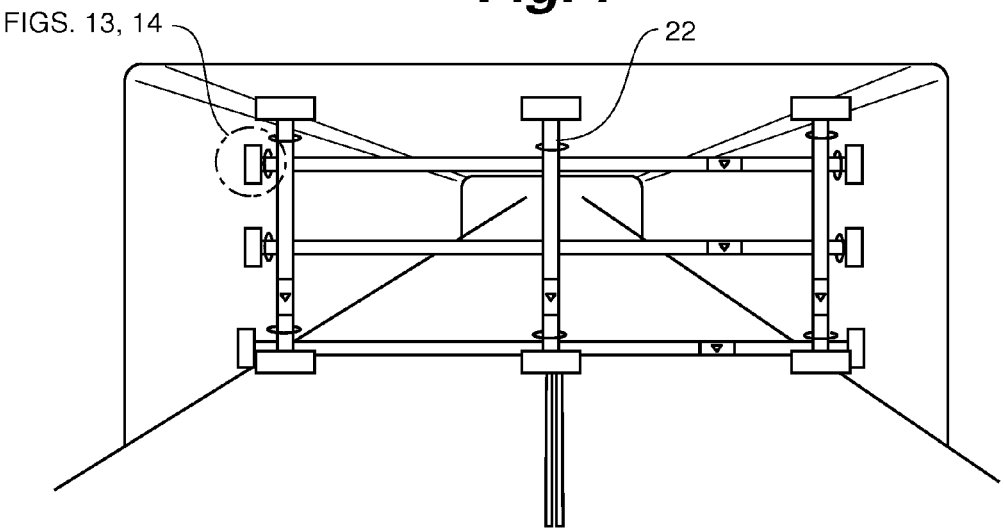
FIGS. 7, 8, and 9 are pictorial representations of the embodiments of the support structures of FIGS. 4, 5 and 6, respectively, with the positioning of attaching loops shown for attaching various embodiments of a removable barrier apparatus formed in accordance with the present disclosure to the respective support structures.
Figure 8:
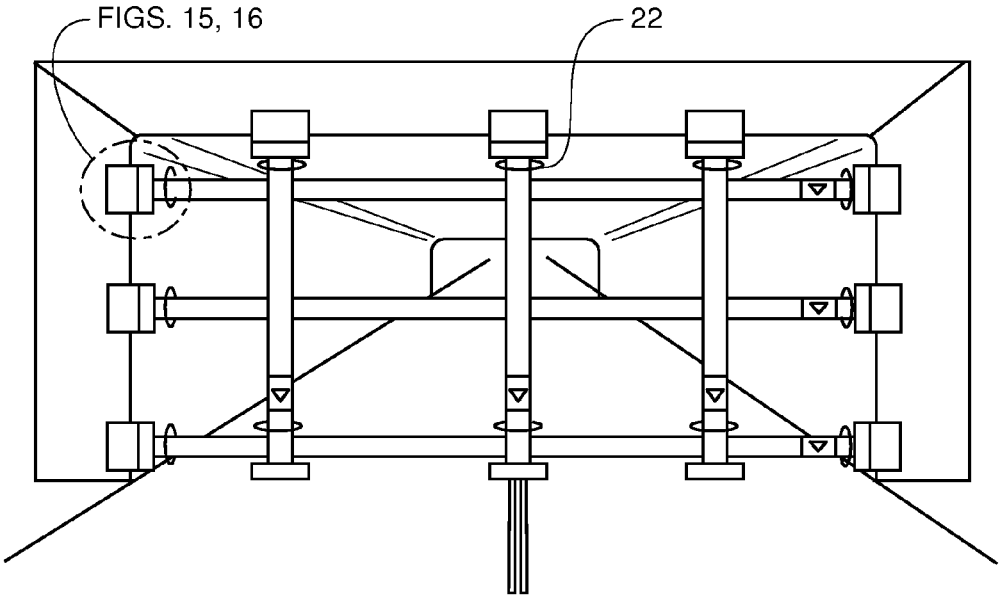
Figure 10:
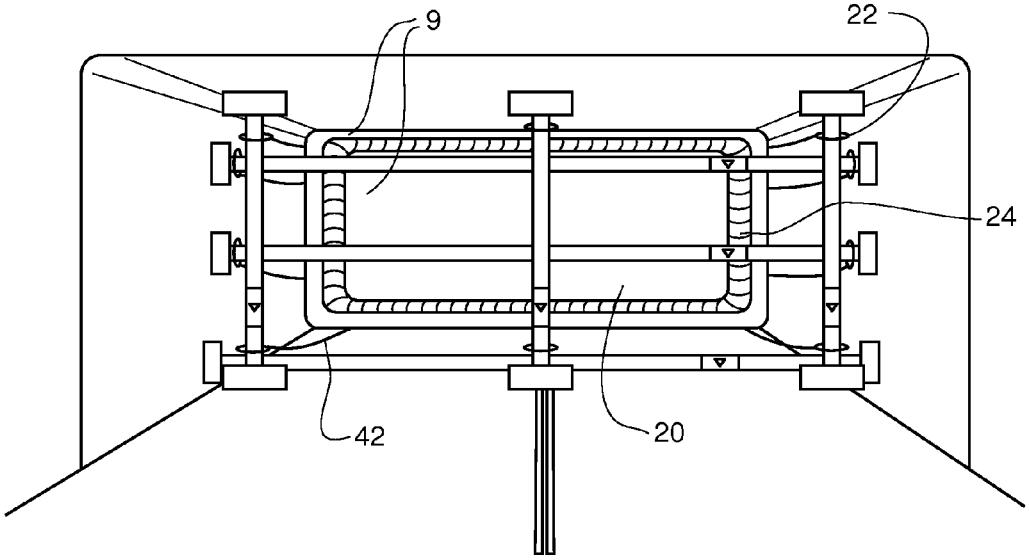
FIGS. 10, 11, and 12 are pictorial representations of embodiments of a removable barrier apparatus formed in accordance with the present disclosure inflated and attached to the support structures of FIGS. 4, 5 and 6, respectively, and installed in the tunnel of FIG. 1.
Figure 11:
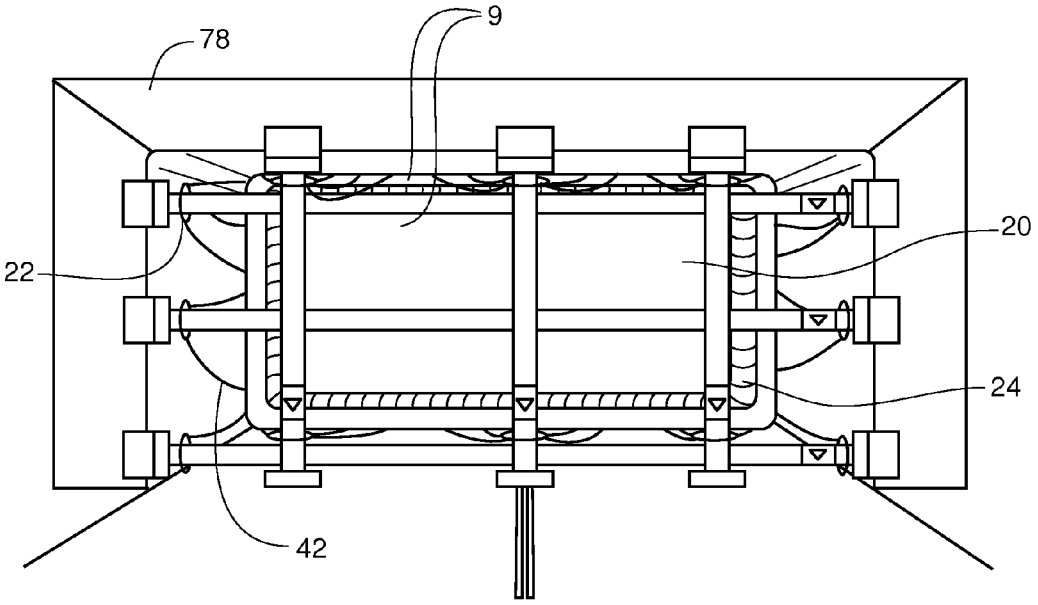

Referring to FIGS. 7 and 8, connecting elements, such as attaching loops 22, for attaching and anchoring the netting structure and retention member to the wall-supported beams are preferably attached upon installation to the wall-supported beams 30 as shown in FIGS. 4 and 5, respectively, proximate the ends of each of the beams 30, i.e., proximate the interior walls of the tunnel. Referring also to FIGS. 10 and 11, once the wall-supported beams 30 are installed, the barrier apparatus 18 can be attached. In some embodiments, the netting structure 9, which includes a mesh (not visible in FIGS. 10 and 11) that surrounds the retention member 20 and pneumatic collar 24 (see FIGS. 22-25, for example), is attached to the supporting beams 30 via loops 22 for attaching and anchoring the barrier apparatus to the wall-supported beams 30.

As shown, in FIGS. 10 and 11, the attaching loops 22 can be attached to the barrier apparatus via an attaching connector 42 to a mesh or netting of the netting structure 9 which encompasses the continuous pliable membrane 20. The attaching connector 42 can be any suitable connecting device between the loop 22 and the mesh, including a rope, a line, or a sling, for example. In some embodiments the attaching connector 42 is integral with the mesh or netting structure. In other embodiments, the attaching connector 42 is also integral with the attaching loop 22.

In some embodiments, as shown in FIGS. 7 and 8, loops 22 are separate from the attaching connector 42 and netting structure 9. The attaching connector can include an attaching clip or other means for attaching to the attaching loop 22 upon installation. In other embodiments, loops 22 can be integral with the attaching connector 42 and netting structure 9. In this case, the loops 22 are positioned on the beams 30 as shown, before securing the beams 30 in the pressure footings. The retaining device 7 and netting structure 9, being integrally connected to the loops, are positioned on the ground or floor of the tunnel behind the wall-supporting beams 30 until the pneumatic collar 24 is inflated.

Any other method known in the art can also be used for attaching and anchoring the removable barrier apparatus formed in accordance with the present disclosure.

Figure 13:
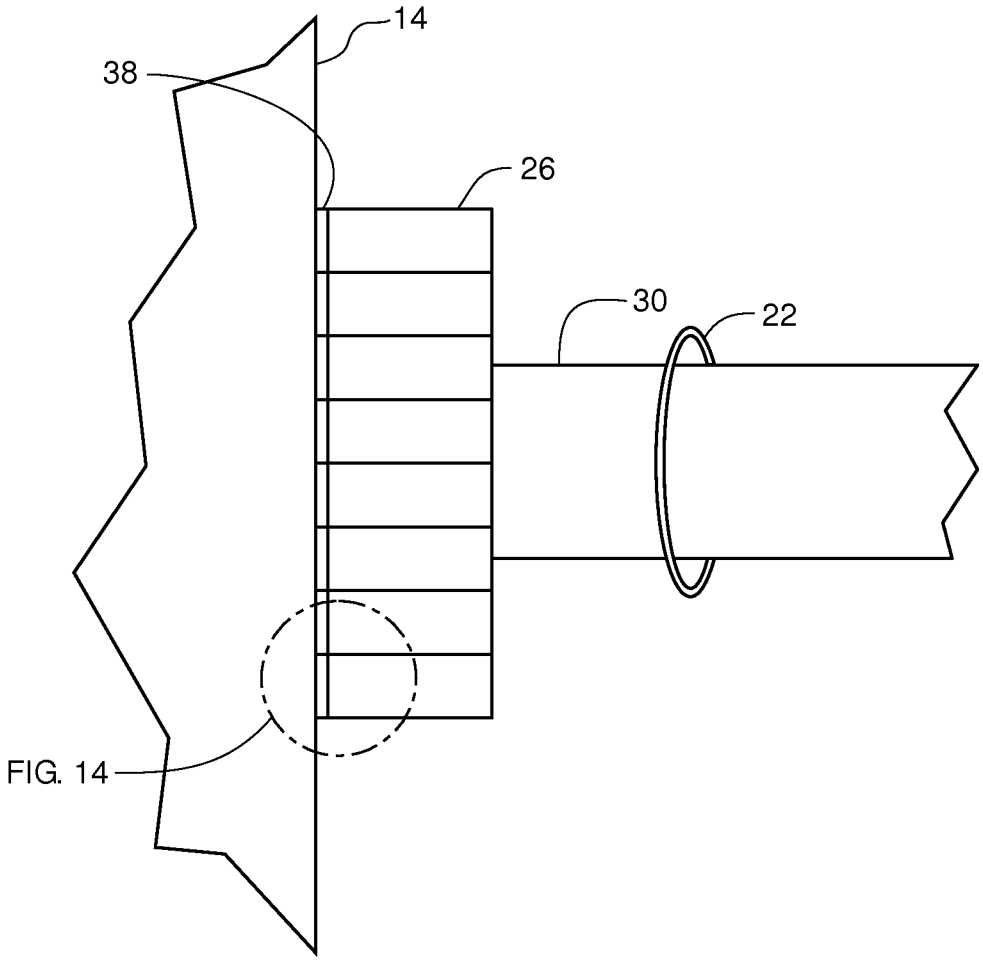
FIGS. 13 and 14 are magnified pictorial representations of a wall-contacting portion of the wall-supported structure of FIG. 7.
Figure 14:
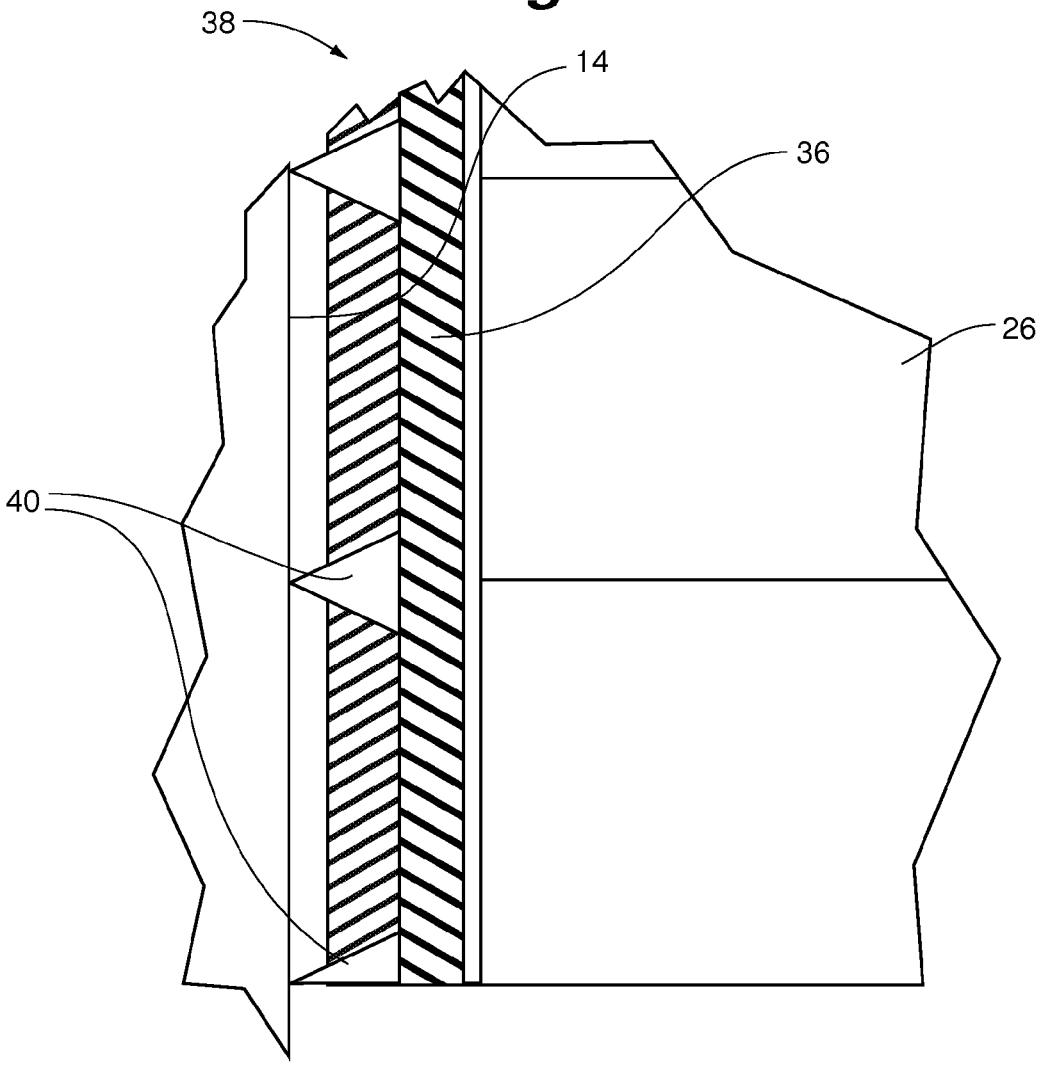

Various methods known in the art can be used to maintain the support beams 30 in position against the walls 14 of the tunnel. FIGS. 13 and 14 provide additional details of one embodiment of the pressure footings 26 of FIG. 7, which includes a backing plate 38 with a wall-contacting surface for gripping the wall. In some embodiments, the backing plate 38 includes open cell rubber 36 and metal cleats 40 for firmly holding the beam 30 to the walls 14 and floor or road surface 16 of the tunnel.

Figure 15:
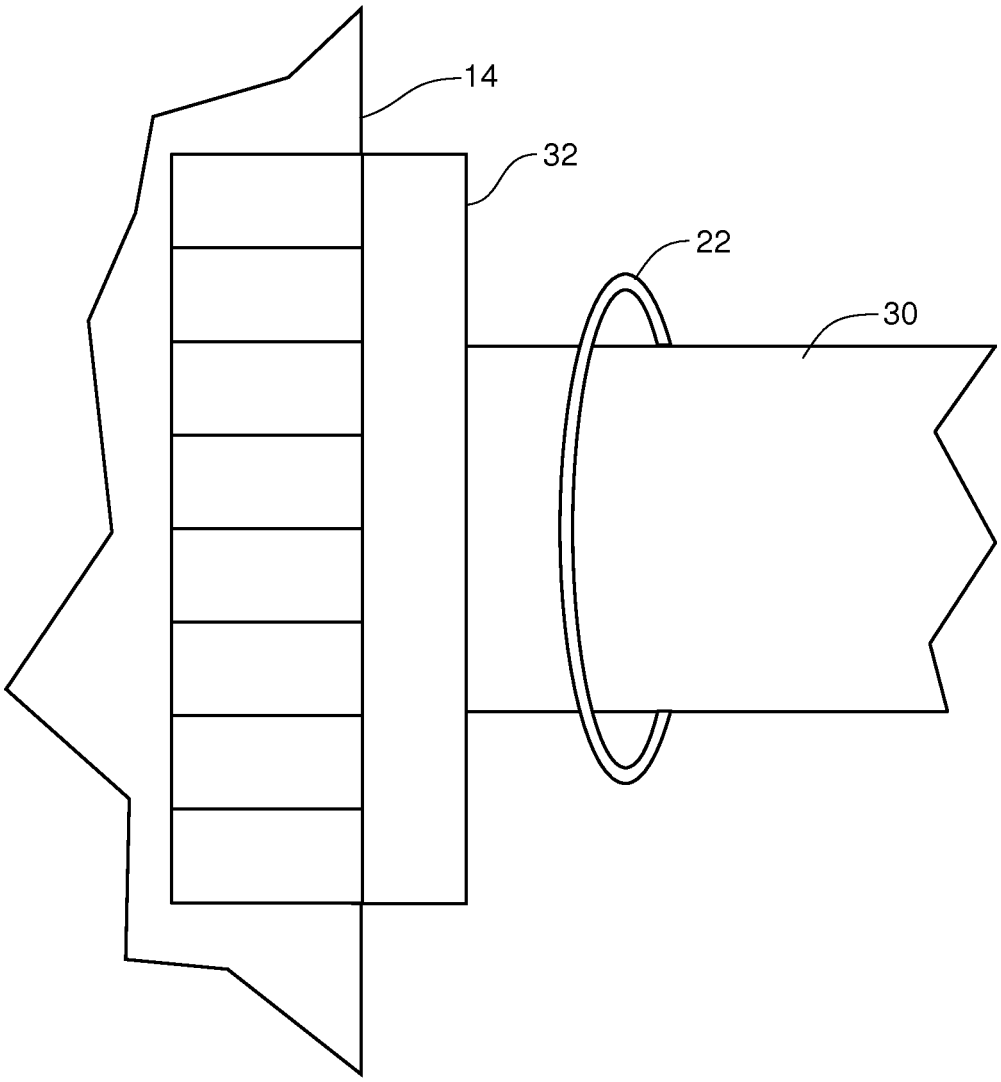
FIGS. 15 and 16 are magnified pictorial representations of a wall-contacting portion of the wall-supported structure of FIG. 8 with attaching loop.
Figure 16:
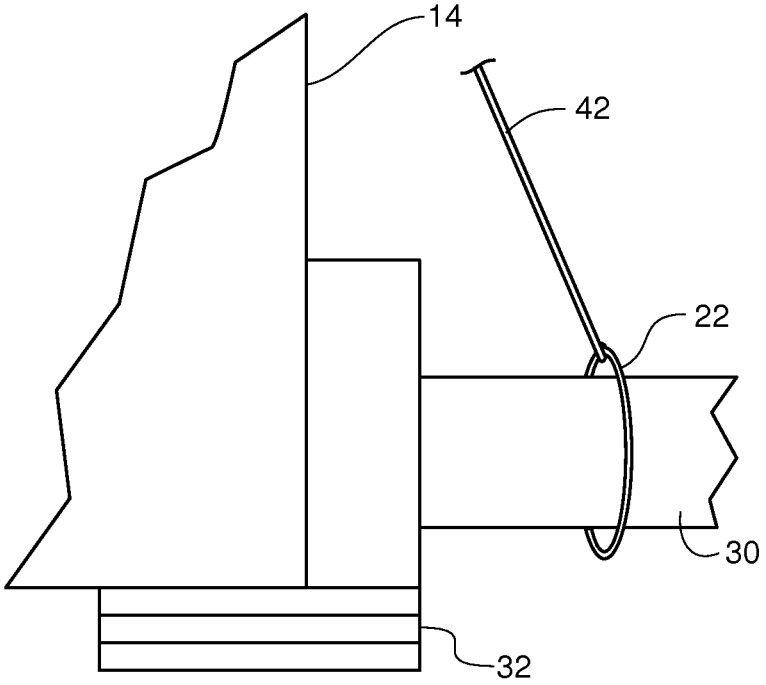

FIGS. 15 and 16 provide two different close up views of one embodiment of the ninety-degree wall-supported footings of FIGS. 8 and 11, which can be formed in accordance with methods known in the art, with the loop 22 and attaching connector 42 (FIG. 16).

Figure 20:
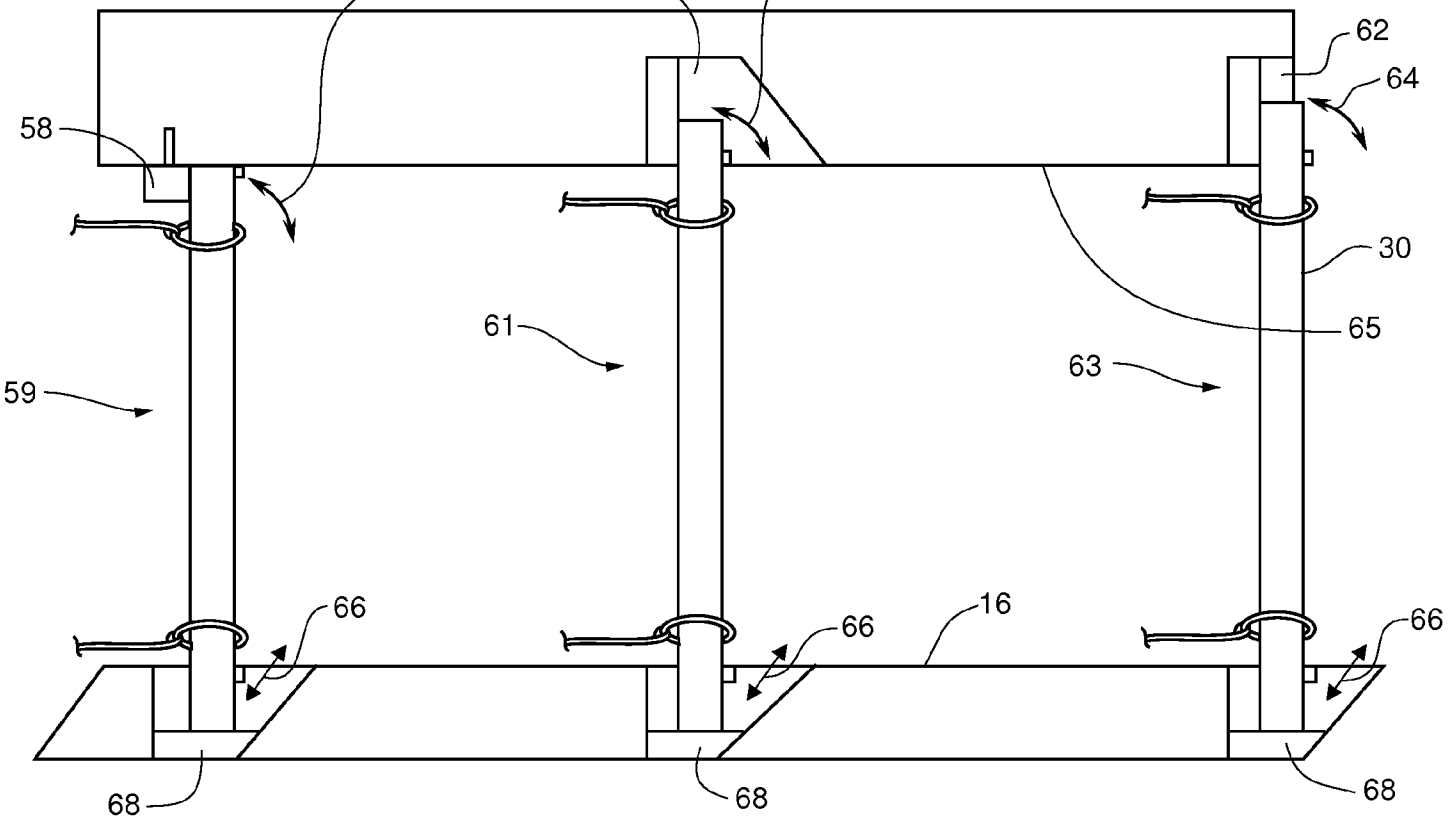
FIG. 20 is a pictorial representation of three embodiments of wall-supported structures formed in accordance with the present disclosure.

Referring to FIG. 20, in some embodiments, at least the lower ends of the wall-supported beams are installed into a surface of the tunnel. For example, in one embodiment 59, the wall-supported beams formed in accordance with the present disclosure can be installed for operation using a removable top blocking 58 on the top wall surface 65 to brace the wall-supported beam 30 against the ceiling 65 of the tunnel, and a below grade footing 68 to anchor the beam 30.

In another embodiment 61, the wall-supported beams formed in accordance with the present disclosure can be installed using a below grade footing 68 in the tunnel floor, and an above grade footing 60 embedded in the tunnel ceiling 65.

In another embodiment 63, the wall-supported beams formed in accordance with the present disclosure can be installed using a below grade footing 68 and above grade footing 62 using the front surface of the entrance wall 78 of the tunnel for support of the beam 30. The travel direction of the top of the beam 64 and of the bottom of the beam 66 for installation is shown in each instance.

Figure 21B:
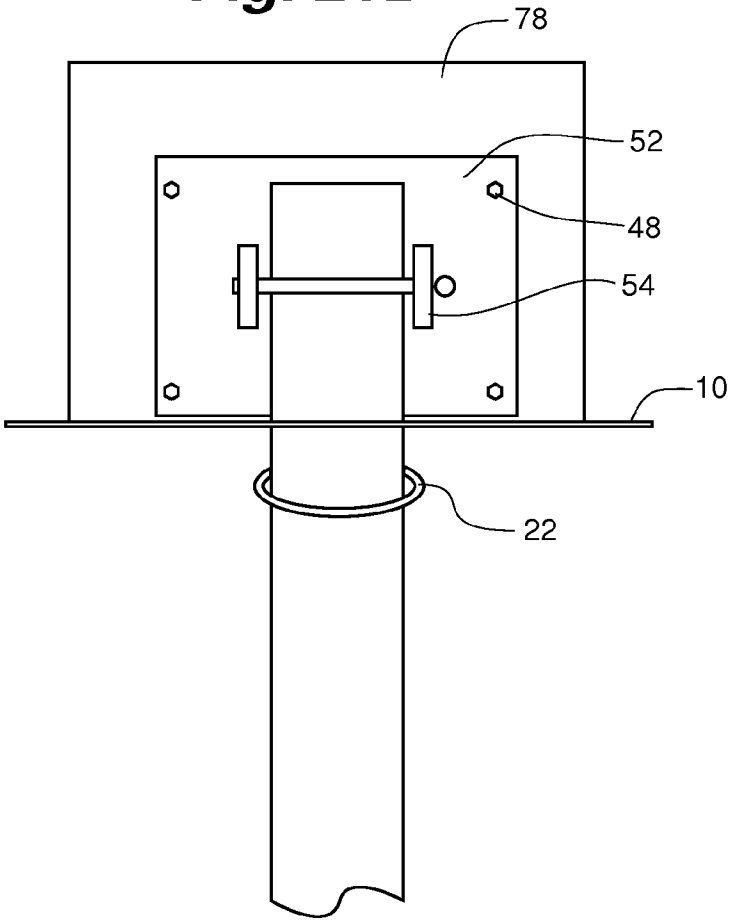
FIG. 21B is a pictorial representation of a front view of the embodiment of a wall-supported structure shown in FIG. 21A.
Figure 21A:
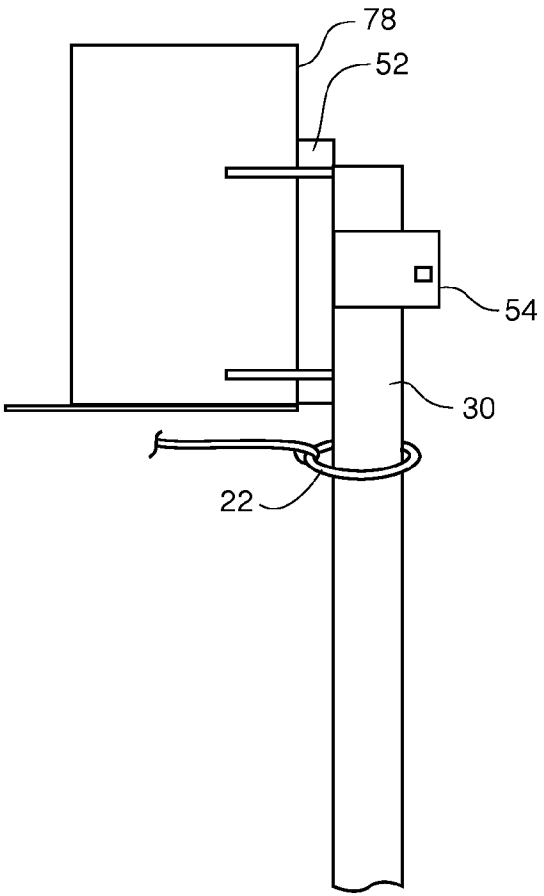
FIG. 21A is a pictorial representation of a side view of an embodiment of a wall-supported structure.

Referring to FIG. 21, in other embodiments, the wall-supported structures can also be installed onto a surface of the tunnel or other walled surface. In FIG. 21, for example, in one embodiment, an upper end of the wall-supported beam 30 is installed against the front surface 78 of the entrance wall of the tunnel using the anchoring unit with metal plate 52 and incorporated closure 54 as shown in FIG. 18.

Any other structure known in the art appropriate for removably attaching and anchoring the barrier apparatus 18, including the fluid retention device 7 and netting structure 9, in operation can also be used.

As described above, the netting structure 9 encompasses the fluid retention device 7 for supporting and anchoring the continuous pliable membrane 20 and pneumatic collar 24 to any of the support structure embodiments of the present disclosure via attaching elements 22.

Referring to FIGS. 22A, 22B, and 23, for example, in one embodiment, the netting structure 9 includes a plurality of attaching elements 22, each of which is attached via an attaching connector 42, to a netting 72 which is shaped and positioned to encompass the fluid retention device 7. The fluid retention device 7 includes a fluid retention member 20, preferably a continuous pliable membrane, and an integral pneumatic collar 24. The collar is shown inflated with air 76 for installation, as shown in FIG. 23.

In some embodiments of a barrier apparatus and system formed in accordance with the present disclosure, an inflation device 74 is provided for inflating the pneumatic collar 24 for installation and, in some embodiments, may remain attached to the pneumatic collar after inflation and during operation, for further maintaining pressure throughout operation.

In additional embodiments, a monitoring device, such as a pressure gauge, can be associated with the inflation device 74 to monitor the pressure of the pneumatic collar during operation. The pressure can be monitored on site or remotely in accordance with methods and devices known to those of ordinary skill in the art. In additional embodiments, the system formed in accordance with the present disclosure further includes a control device, including a feedback circuit, for example, to monitor the pressure in the pneumatic collar and to inflate the pneumatic collar using the inflation device in response to a predetermined measured drop in the pressure in order to maintain constant pressure, or to stay within a predetermined range of pressures, in the pneumatic collar. It should be noted that if the fluid retention device member is filled with water, for example, the pressure generated on the membrane by the water pushing against the walls of the tunnel would make the air pressure in the pneumatic collar less critical. Accordingly, additional parameters can be measured and monitored for controlling the optimal inflation of the collar, such as the rate of drop in the air pressure in the pneumatic collar.

Figure 24:
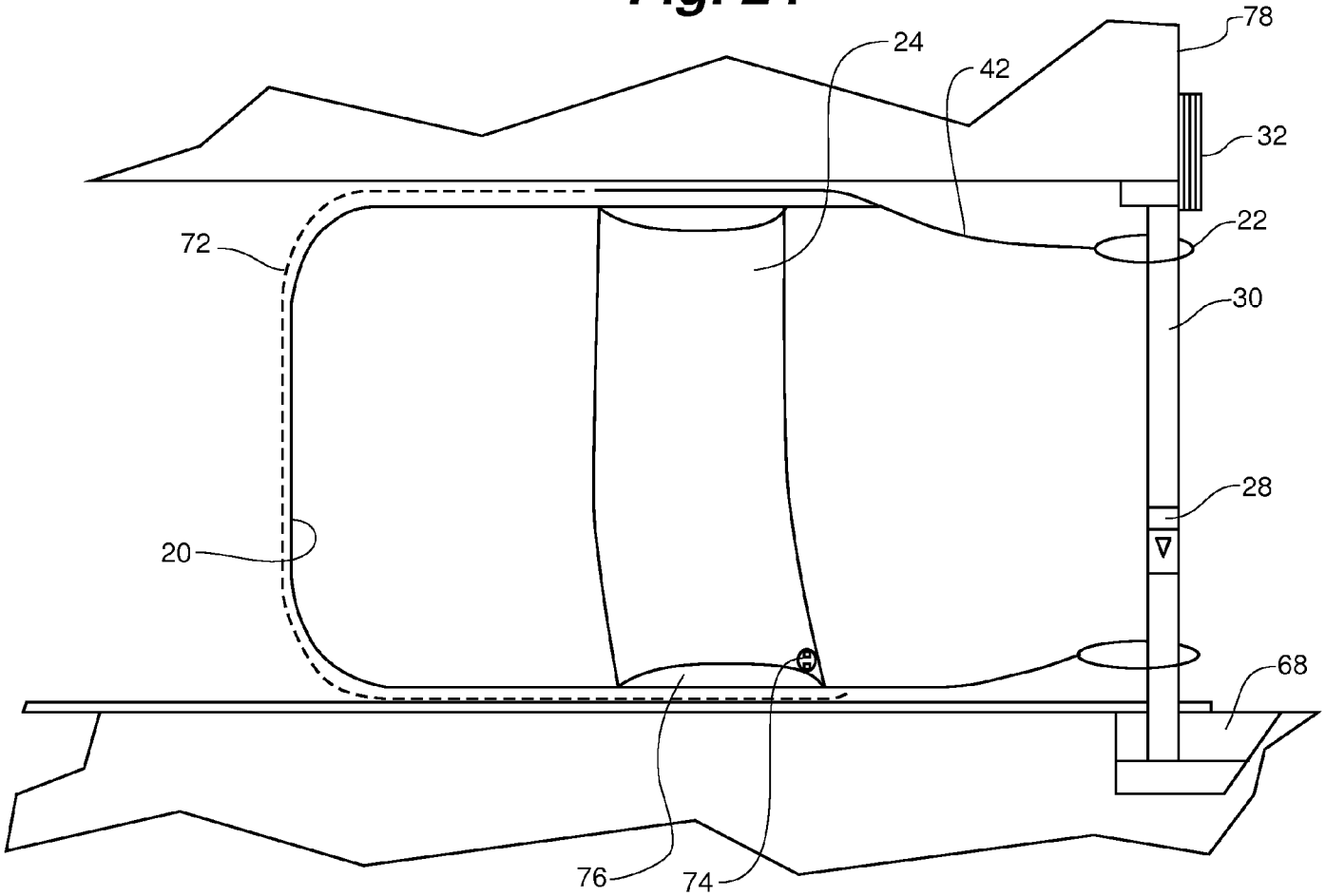
FIG. 24 is a pictorial representation of a side view of another embodiment of a system formed in accordance with the present disclosure installed in a tunnel, including the removable barrier apparatus of FIGS. 22A and 22B and an embodiment of a wall-supporting structure of the present disclosure.

Referring to FIG. 24, in another embodiment of a system and barrier apparatus formed in accordance with the present disclosure, the netting structure 9 includes a plurality of attaching loops 22, each of which is preferably attached via attaching connector 42, to the netting or mesh 72, which is shaped and positioned to encompass the fluid retention device 7. The fluid retention device 7 includes the fluid retention member 20, which can be a continuous pliable membrane, and integral pneumatic collar 24. The collar is shown inflated with air 76. An inflation device 74 is provided for inflating the collar 24 for installation, for example, in a support structure using a ninety-degree pressure-generating wall support 32 as shown in FIG. 5 and the below grade footing 68 of FIG. 20, and for further maintaining pressure throughout operation.

Figure 22C:
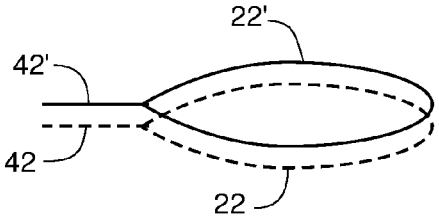
FIG. 22C is a pictorial magnified representation of the loops of FIG. 22A for attaching the removable barrier apparatus to a support structure.

Similarly, in another embodiment shown in FIGS. 25A and 25B, the top ends of the wall-supported beams 30 are surface mounted to the front face 78 of the entrance wall of the tunnel, as shown in FIG. 21, and anchored in below grade footing 68. Referring also to FIGS. 22A-22C, the netting 9 and fluid retention member 20 are attached to the attaching connectors 42, 42', which in turn are integrated with loops 22, 22' to secure the removable barrier apparatus to the wall-supported beams 30. In the particular embodiment shown, only vertical wall-supported beams are used. Though not shown in FIGS. 25A and 25B, it can be appreciated that in this embodiment, a modification to the road structure could be implemented to form recesses in the road leading to the tunnel for storing the beams 30, and easily removable covers over them to form an appropriate driving surface when the beams 30 are stored therein. In this way, the beams 30 could be quickly and easily rotated from a horizontal storage position to a vertical position against the front face 78 of the tunnel for operation.

Figure 25A:
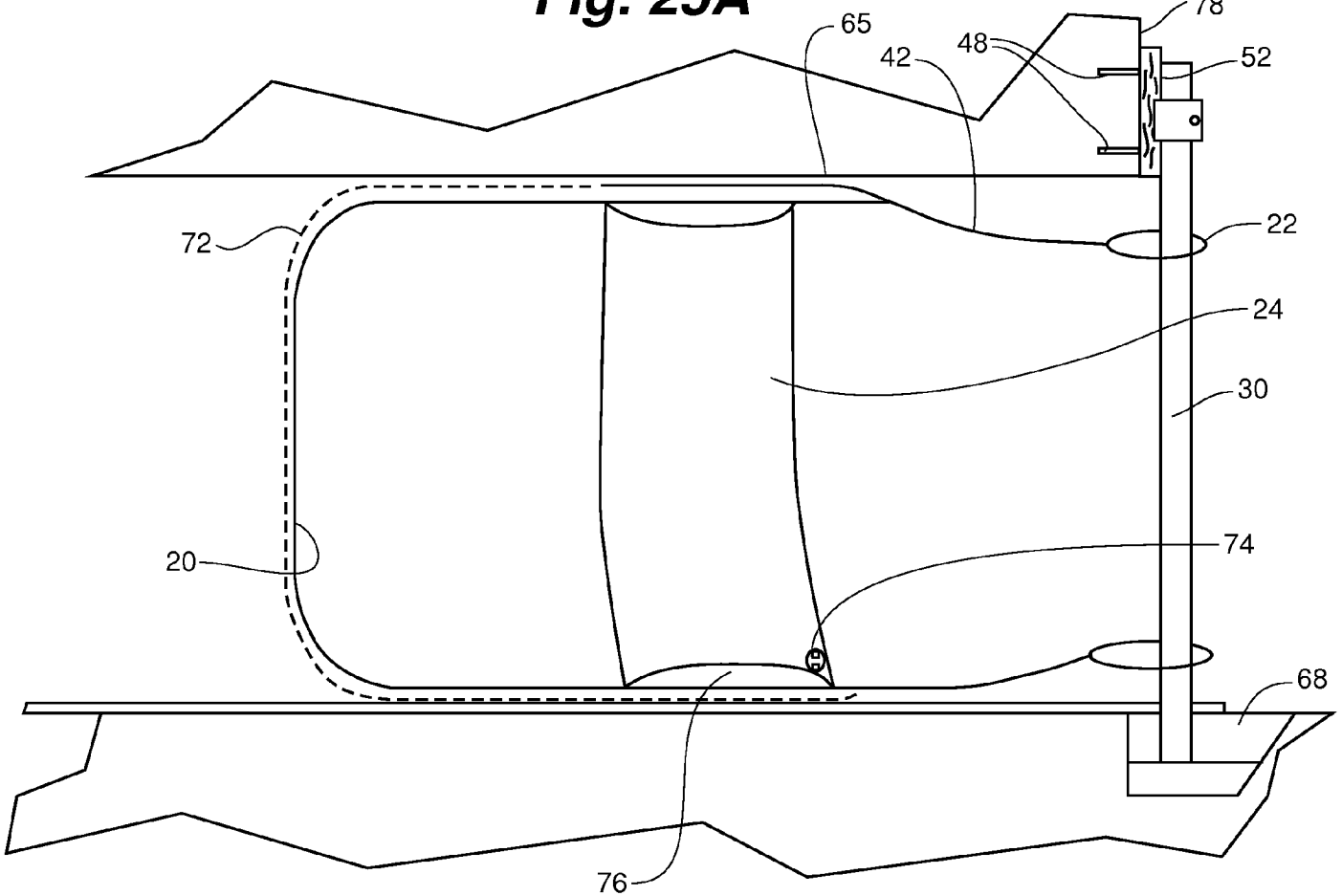
FIGS. 25A and 25B are pictorial representations of a side view and front view, respectively, of an embodiment of a system of the present disclosure installed in a tunnel, which includes the removable barrier apparatus of FIGS. 22A and 22B attached to an embodiment of a wall-supporting structure of the present disclosure.
Figure 25B:
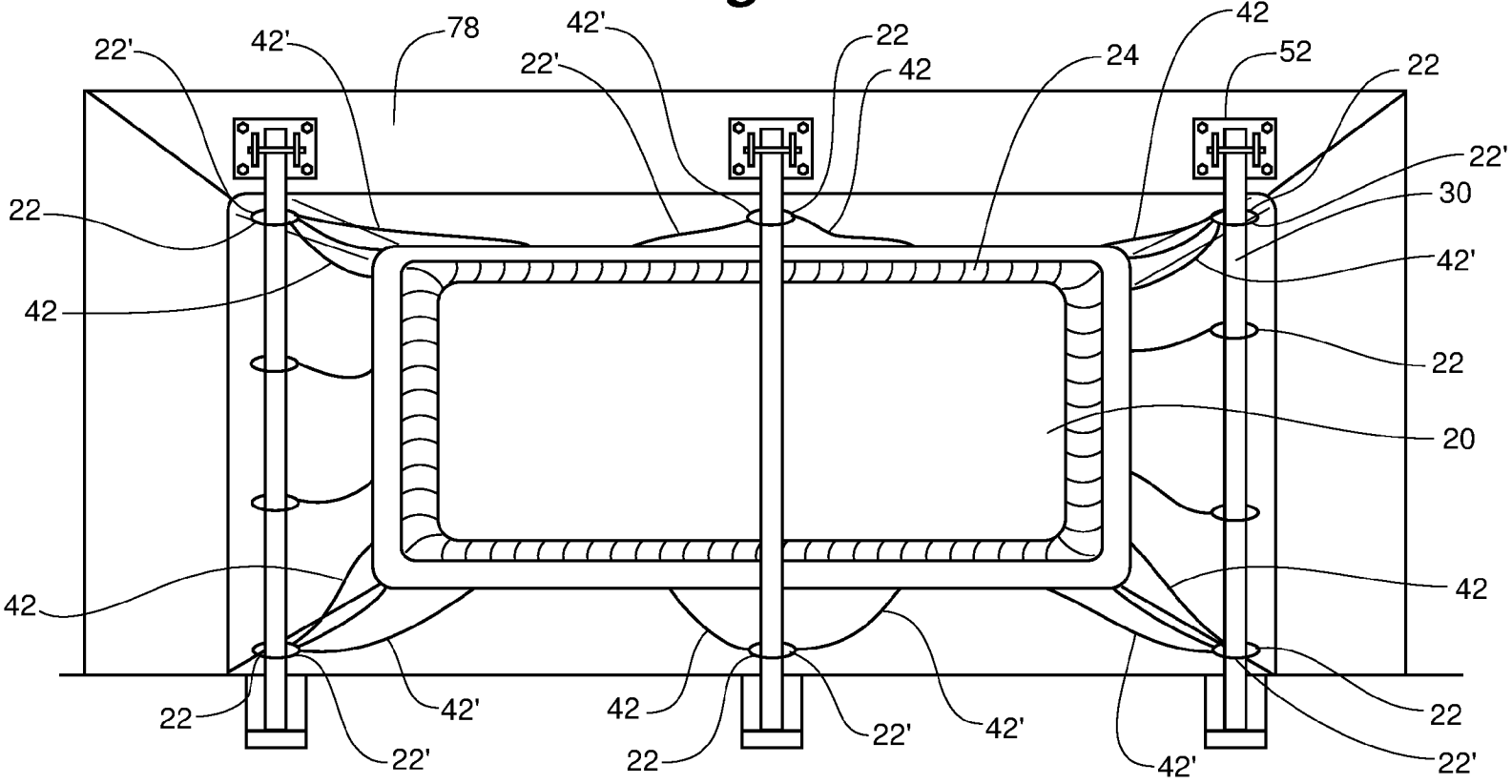

In another embodiment, the barrier apparatus could be stored with the support structure formed in accordance with FIGS. 25A and 25B, and still attached to the beams 30. A larger recess spanning the width of the tunnel would be needed to accomplish this, but otherwise, very quick installation could be achieved. A dedicated compressor for inflating the pneumatic collar via the inflation device to complete the installation could also be stored on site, or locally sourced. The inflation device is preferably configured for use with any number of commercial compressors.

Accordingly, the systems and methods formed in accordance with the present disclosure provide for the quick installation of a removable barrier apparatus formed in accordance with the present disclosure to walled building structures to protect them from damage from floods and from other hazards such as toxic gases. Advantageously, in the event of a flood or other naturally occurring or man-made disaster, the removable barrier apparatus formed in accordance with the present disclosure can be quickly removed once the disaster has passed and normal traffic through the tunnel, for example, can be immediately resumed.

While the methods and system of the present disclosure have been particularly shown and described with reference to specific embodiments, it should be apparent to those skilled in the art that the foregoing is illustrative only and not limiting, having been presented by way of example only. For example, though the embodiments of a removable barrier described herein are described primarily for attaching to a tunnel, it should be understood that the removable barrier can also be adapted to any walled structure, including a subway, hallway or pipe. In addition, various changes in form and detail may be made therein without departing from the spirit and scope of the disclosure. Therefore, numerous other embodiments are contemplated as falling within the scope of the present methods and system as defined by the accompanying claims and equivalents thereto.

What is claimed is:

1. A system for preventing fluid from entering a walled structure, the system comprising: a support structure, the support structure configured for fixing to at least one surface of a walled structure; and a barrier apparatus attachable and anchorable to the support structure, the barrier apparatus comprising a fluid retention member, the fluid retention member including a pliable membrane, an opening, and a pneumatic collar in the form of an annular ring proximate the opening and integral with the pliable membrane, the pliable membrane extending beyond the opening and the pneumatic collar and configured to take a shape of an interior surface of the walled structure in use and for intercepting a fluid entering the walled structure through the opening, wherein the pliable membrane is further configured to fill up with the fluid that enters through the opening and to expand and press against the interior surface of the walled structure, the pneumatic collar being positioned around an interior surface of the pliable membrane and configured to press and hold the pliable membrane against an interior surface of the walled structure upon installation.

2. The system of claim 1, wherein the barrier apparatus is further configured so that, in use, increasing pressure from the fluid intercepted by the fluid retention member presses the collar and the pliable membrane against the interior surface of the walled structure, thereby creating and tightening a seal between the barrier apparatus and the walled structure.

3. The system of claim 1, wherein the pneumatic collar is inflatable for installation and operation and collapsible for storage.

4. The system of claim 3, further comprising an inflating device configured for inflating the pneumatic collar.

5. The system of claim 4, further comprising a pressure gauge configured for monitoring a pressure of the pneumatic collar during operation.

6. The system of claim 5, further comprising a control device, the control device activating the inflating device to further inflate the pneumatic collar in response to the pressure gauge monitoring a predetermined pressure drop in the pressure of the pneumatic collar during operation.

7. The system of claim 1, the barrier apparatus further comprising a netting structure, the netting structure encompassing the pliable membrane, the netting structure being positioned between the pliable membrane and the interior surface of the walled structure during use and configured for attaching and anchoring the netting structure and the fluid retention member to the support structure.

8. The system of claim 7, each of the netting structure and the fluid retention member including at least one line attached to and extending therefrom, said at least one line having an attaching element on its free end for attaching and anchoring the netting structure and the fluid retention member to the support structure.

9. The system of claim 7, wherein the fluid retention member and the netting structure are separately attachable to the support structure.

10. The system of claim 8, wherein the support structure comprises a plurality of anchoring devices permanently attached to and spaced around a front entrance surface of the walled structure, the plurality of anchoring devices configured for attaching the attachment element of each of said at least one line of the netting structure and the fluid retention member thereto, the barrier apparatus being removably attachable to the plurality of anchoring devices.

11. The system of claim 1, wherein the support structure comprises a plurality of wall-supported beams positioned between opposing surfaces of the walled structure, and including pressure-generating footings configured for installing and anchoring the wall-supported beams to the walled structure, each of the wall-supported beams comprising a connecting element proximate each of its ends, the barrier apparatus being removably attachable and anchorable to the support structure via the connecting elements.

12. The system of claim 11, wherein the plurality of wall-supported beams are vertically positioned, each including a pressure-generating ninety-degree wall-supported footing at an upper end configured for removably attaching to a front surface of the walled structure, each of the wall-supported beams further configured for detaching the upper end from the walled structure and reclining the wall-supported beams to a horizontal position when not in use.

13. The system of claim 1, wherein the walled structure is one of a tunnel and subway.

14. A removable barrier apparatus for preventing fluid from entering a walled structure, the barrier apparatus configured for operably attaching and anchoring to the walled structure, the barrier apparatus comprising:

a fluid retention member including an opening, a pneumatic collar, and a pliable membrane extending beyond the opening and the pneumatic collar, wherein the pliable membrane is configured to take a shape of an interior surface of the walled structure in use and further configured for intercepting a fluid entering the walled structure through the opening;

wherein the pneumatic collar is in the form of an annular ring integral with the pliable membrane and is positioned around an interior surface of the pliable membrane and proximate the opening, the pneumatic collar configured to press and hold the pliable membrane against the interior surface of the walled structure upon installation, the barrier apparatus being configured such that, in use, the pliable membrane fills up with the fluid that enters through the opening and increasing pressure from the fluid intercepted by the fluid retention member presses the pneumatic collar and the pliable membrane against the interior surface of the walled structure, thereby creating and tightening a seal between the barrier apparatus and the walled structure; and a netting structure, the netting structure encompassing the pliable membrane, the netting structure being positioned between the pliable membrane and the interior surface of the walled structure during use and further configured for operably attaching and anchoring the fluid retention member and the netting structure to the walled structure.

15. The barrier apparatus of claim 14, wherein the pneumatic collar is inflatable for installation and operation and collapsible for storage.

16. The barrier apparatus of claim 15, further comprising an inflating device configured for inflating the pneumatic collar, a pressure gauge configured for monitoring a pressure of the pneumatic collar during operation, and a control device, the control device activating the inflating device to further inflate the pneumatic collar in response to the pressure gauge monitoring a predetermined pressure drop in the pressure of the pneumatic collar during operation.

* * * * *